US008806989B2

(12) United States Patent
Ohno

(10) Patent No.: US 8,806,989 B2
(45) Date of Patent: Aug. 19, 2014

(54) MONKEY WRENCH

(76) Inventor: Yasushi Ohno, Toyokawa (JP)

( * ) Notice: Subject to any disclaimer, the term of this patent is extended or adjusted under 35 U.S.C. 154(b) by 0 days.

(21) Appl. No.: 13/983,450

(22) PCT Filed: Jun. 21, 2012

(86) PCT No.: PCT/JP2012/065813

§ 371 (c)(1),
(2), (4) Date: Aug. 2, 2013

(87) PCT Pub. No.: WO2013/054570

PCT Pub. Date: Apr. 18, 2013

(65) Prior Publication Data

US 2013/0312574 A1 Nov. 28, 2013

(30) Foreign Application Priority Data

Oct. 12, 2011 (JP) ..... 2011-224883
Apr. 23, 2012 (JP) ..... 2012-097940

(51) Int. Cl.
*B25B 13/20* (2006.01)
*B25B 13/14* (2006.01)

(52) U.S. Cl.
CPC ..... *B25B 13/20* (2013.01); *B25B 13/14* (2013.01)
USPC ..... 81/145; 81/129; 81/165

(58) Field of Classification Search
USPC ..... 81/129, 145, 146, 179, 109, 165, 170, 81/DIG. 5
See application file for complete search history.

(56) References Cited

U.S. PATENT DOCUMENTS

| | | | | | |
|---|---|---|---|---|---|
| 172,649 | A * | 1/1876 | Pease | 81/129 |
| 1,422,563 | A * | 7/1922 | Woodthorpe | 81/129 |
| 1,541,593 | A * | 6/1925 | Scott | 81/145 |
| 1,616,612 | A * | 2/1927 | Dodds | 81/129 |
| 1,715,426 | A * | 6/1929 | Peterson | 81/129 |
| 3,948,120 | A | 4/1976 | Hancock | |
| 5,331,868 | A | 7/1994 | Elmore | |
| 6,470,773 | B1 * | 10/2002 | Wu | 81/165 |
| D639,128 | S * | 6/2011 | Jorgensen | D8/22 |

FOREIGN PATENT DOCUMENTS

| | | | |
|---|---|---|---|
| JP | 60-131023 | U | 9/1985 |
| JP | 60-194469 | U | 12/1985 |
| JP | 61-188081 | A | 8/1986 |
| JP | 63-179064 | U | 11/1988 |
| JP | 04-063411 | U | 5/1992 |
| JP | 5-5360 | U | 1/1993 |
| JP | 5-177558 | A | 7/1993 |

(Continued)

OTHER PUBLICATIONS

International Search Report dated Aug. 7, 2012, issued in corresponding application No. PCT/JP2012/065813.

*Primary Examiner* — Hadi Shakeri
(74) *Attorney, Agent, or Firm* — Westerman, Hattori, Daniels & Adrian, LLP

(57) ABSTRACT

A positioning function when a width-across-flats dimension of a tool is adjusted and a function of preventing a deviation in the adjusted width-across-flats dimension are fulfilled by a projection of a flat spring part being fitted into each fitting recess.

By selecting the line of a fitting recess to be used according to the standard of an object to be clamped such as a nut, the positioning function and the function of preventing a deviation can be easily and reliably fulfilled even for the width-across-flats dimensions of different standards.

20 Claims, 19 Drawing Sheets

(56) References Cited

FOREIGN PATENT DOCUMENTS

| | | | |
|---|---|---|---|
| JP | 07-20609 | U | 4/1995 |
| JP | 10-217139 | A | 8/1998 |
| JP | 2000-071177 | A | 3/2000 |
| JP | 2000-190241 | A | 7/2000 |
| JP | 2001-047373 | A | 2/2001 |
| JP | 2005-349501 | A | 12/2005 |
| JP | 2006-346849 | A | 12/2006 |
| JP | 2007-030046 | A | 2/2007 |
| JP | 2011-093016 | A | 5/2011 |

* cited by examiner

MONKEY WRENCH

TECHNICAL FIELD

It is an object of the present invention to provide: a monkey wrench that ensures a simplified structure and reliably provides a positioning function when a tool width-across-flats size is adjusted and a locking function for the adjusted width-across-flats size even in the case where rattling of a movable jaw occurs due to deformation and abrasion of a sliding surface; and a monkey wrench that simply and reliably provides the positioning function when the tool width-across-flats size is adjusted and the locking function for the adjusted width-across-flats size also with respect to width-across-flats sizes of different standards.

BACKGROUND ART

A monkey wrench can be adjusted to a spacing between a fixed jaw and a movable jaw corresponding to a width-across-flats size of an object to be sandwiched (such as a bolt and a nut). Thus, the monkey wrench is widely used as a convenient tool. On the contrary, since the spacing (hereinafter referred to as "the tool width-across-flats size") between the fixed jaw and the movable jaw is adjusted by a space adjusting mechanism that is constituted by a worm gear, the tool width-across-flats size is likely to change during a fastening or loosening operation. Accordingly, a corner portion of a hexagonal shape of the bolt or the nut is likely to be rounded. Further, the monkey wrench cannot often sandwich a bolt and a nut that each have even the same width-across-flats size. Thus, readjustment of the tool width-across-flats size is frequently required.

Therefore, for example, Patent Literatures 1 to 4 disclose a mechanism that locks (fixes) rotation of the worm gear in any position. Patent Literatures 5 and 6 disclose a mechanism that reduces looseness (rattling) of a worm gear. These techniques reduce changes in the tool width-across-flats size during the fastening or loosening operation.

Regarding the monkey wrench, in the case where a different bolt or a different nut is used as a target, a worker needs to adjust the tool width-across-flats size corresponding to the bolt or the nut. This operation is troublesome for the worker. In this respect, as disclosed in Patent Literatures 7 and 8, an index scale that indicates a diameter of the target bolt is disposed on the tool. Additionally, the index scale is read to facilitate the adjustment operation of the tool width-across-flats size, as a known technique. These techniques of Patent Literatures 7 and 8, unlike the techniques of Patent Literatures 1 to 6, cannot reduce the change in the tool width-across-flats size.

As techniques that ensure the compatibility with reduction of the change in the tool width-across-flats size and facilitate the adjustment operation for the tool width-across-flats size, Patent Literatures 9 to 11 disclose techniques using ball plungers. With these techniques, for example, a ball of the ball plunger disposed at a movable jaw fits each of a plurality of notches depressed on a sliding surface of a wrench body. Simultaneously, the movable jaw is moved. This facilitates adjustment of the tool width-across-flats size and prevents a change (difference) in the width-across-flats size.

Patent Literature 12 discloses the following technique. In a leaf spring portion, a base end side is firmly fixed to a side surface of a movable jaw while a distal end side is disposed facing a side surface of a wrench body. The leaf spring portion is formed as a leaf spring that is elastically deformable in a contact and separation direction with respect to the side surface of wrench body, and disposed on one side surface and the other side surface of the movable jaw.

CITATION LIST

Patent Literature

Patent Literature 1: JP-A-5-177558
Patent Literature 2: JP-A-2005-349501
Patent Literature 3: JP-A-2006-346849
Patent Literature 4: JP-A-2007-030046
Patent Literature 5: JP-A-10-217139
Patent Literature 6: JP-A-2001-047373
Patent Literature 7: JP-UM-A-63-179064
Patent Literature 8: JP-A-2000-71177
Patent Literature 9: JP-UM-B-60-194469
Patent Literature 10: JP-UM-A-5-5360
Patent Literature 11: JP-A-2011-093016
Patent Literature 12: U.S. Pat. No. 3,948,120

SUMMARY OF INVENTION

Technical Problem

However, in the techniques of Patent Literatures 9 and 10, in the case where the movable jaw, the sliding surface of the wrench body, or the like is deformed or worn and causes rattling of the movable jaw with respect to the wrench body, the ball is likely to drop out of the notch in association with the rattling. Additionally, a coiled spring provides an elastic force that acts in a direction to facilitate rattling (separate the movable jaw from the sliding surface), that is, a direction to rotate the worm. Therefore, a problem arises in that it is difficult to reliably provide a positioning function for adjusting the tool width-across-flats size and a locking function for the adjusted width-across-flats size.

In the configuration like the technique of Patent Literature 11, the notch is disposed on the end surface of the worm. A displacement of the ball plunger when the ball plunger fits the notch is used to operate a counter. This increases the number of components and it is necessary to dispose the respective components inside of the wrench body. A problem has arisen in that this causes a complicated structure.

The technique of Patent Literature 12 suppresses rattling of the movable jaw with respect to the wrench body in a direction where the leaf spring portion is pressed into the side surface of the wrench body while not providing the positioning function for adjusting the tool width-across-flats size and the locking function for the adjusted width-across-flats size, which has been a problem.

Here, none of the monkey wrenches described above can sufficiently provide their function under the condition where there is no unified standard for the width-across-flats size of the object to be sandwiched. That is, regarding the bolts and nuts, various standards (such as the metric thread standard, the Whitworth screw thread standard, the unified thread standard) are prescribed. Commonality is not shared among these standards of the width-across-flats sizes, and various width-across-flats sizes are mixed. Accordingly, in the case where a pitch (spacing) of a fitting depressed portion depressed on the side surface of the wrench body is set compliant to, for example, the metric thread standard, the pitch cannot adapt to the width-across-flats size of the Whitworth screw thread standard (that is, provide the positioning function and the locking function with respect to this width-across-flats size), which has been a problem.

The present invention has been made to address the above-described problems, and it is an object of the present invention to provide: a monkey wrench that ensures a simplified structure and reliably provides a positioning function when a tool width-across-flats size is adjusted and a locking function for the adjusted width-across-flats size even in the case where rattling of a movable jaw occurs due to deformation and abrasion of a sliding surface; and a monkey wrench that simply and reliably provides the positioning function when the tool width-across-flats size is adjusted and the locking function for the adjusted width-across-flats size also with respect to width-across-flats sizes of different standards.

Solution to Problem

According to the monkey wrench in some first examples, when the tool width-across-flats size is adjusted, the protrusion of the leaf spring portion disposed at the movable jaw fits each of the plurality of fitting depressed portions depressed on the side surface of the wrench body to provide a positioning function for the protrusion. In a state where the protrusion fits the fitting depressed portion, the wrench body and the movable jaw form a coupled state via the leaf spring portion. This provides a locking function for the adjusted width-across-flats size.

In this case, the wrench body includes the plurality of rows formed of the plurality of fitting depressed portions parallel to one another at intervals in the direction perpendicular to the advancing/retreating direction of the movable jaw. This allows setting pitches (spacings) of the fitting depressed portions compliant to different standards in each row. Thus, corresponding to a standard of an object to be sandwiched, selecting a row for the fitting depressed portion to be used (that is, setting the position of the leaf spring portion in a position where the protrusion can fit each fitting depressed portion of the selected row) ensures compliance to the width-across-flats size of different standards. Additionally, the positioning unit is disposed for positioning the leaf spring portion. This facilitates disposing the leaf spring portion in a position where the protrusion can fit the selected row.

As described above, according to some first examples, the configuration simply and reliably provides the positioning function for adjusting the tool width-across-flats size and the locking function for the adjusted width-across-flats size with respect to the width-across-flats size of different standards.

According to the monkey wrench in some second examples, in addition to the effect provided by the monkey wrench in the first examples, the fitting groove where the leaf spring portion is mounted on the inner side is depressed at the movable jaw. The fitting groove includes the inner wall surfaces that restrict a movement direction of the leaf spring portion to one direction only. When the position (that is, the position of the protrusion with respect to the plurality of rows) of the leaf spring portion is adjusted, this improves working efficiency of the adjusting operation.

In this case, the inner wall surfaces of the fitting groove extend in the direction perpendicular to the advancing/retreating direction of the movable jaw to restrict movement of the leaf spring portion in the advancing/retreating direction of the movable jaw. Accordingly, when fastening and loosening operations are performed by sandwiching an object to be sandwiched between the fixed jaw and the movable jaw, this minimizes a component force (approximately zero) in a moving direction along the fitting groove of the leaf spring portion among reactive forces acting on the leaf spring portion from the inner wall surfaces of the fitting groove. As a result, this reduces displacement of the position of the leaf spring portion by the reactive forces from the inner wall surfaces of the fitting groove during the fastening or loosening operation.

According to the monkey wrench in some third examples, in addition to the effect provided by the monkey wrench in the first or second examples, the wrench body includes a flat surface portion formed in a flat surface shape along the advancing/retreating direction of the movable jaw. The positioning unit allows positioning the leaf spring portion in a position where the protrusion is arranged in the flat surface portion. This forms a configuration that advances and retreats the movable jaw in a state where the protrusion does not fit the fitting depressed portion. That is, this allows the worker to adjust the position of the leaf spring portion to select any of the following configurations. Fitting between the protrusion and the fitting depressed portion is used to ensure a configuration that provides the positioning function and the locking function of the width-across-flats size. The protrusion is not fitted to the fitting depressed portion (that is, the protrusion disposed on the flat surface portion) to ensure a configuration that does not provide the positioning function and the locking function of the width-across-flats size.

According to the monkey wrench in some fourth examples, in addition to the effect provided by the monkey wrench in any one of the first to third examples, the wrench body includes a continuous depressed groove formed to fit the protrusion. The continuous depressed groove continuously extends in a groove shape along the advancing/retreating direction of the movable jaw. The positioning unit allows positioning the leaf spring portion in a position where the protrusion fits the continuous depressed groove. Accordingly, in a state where the fitting between the protrusion and the continuous depressed groove is maintained, the configuration allows the movable jaw to advance and retreat. That is, in a state where the tool width-across-flats size is adjusted to any width-across-flats size, the wrench body and the movable jaw maintain a state coupled via the leaf spring portion. As a result, this reduces rattling of the movable jaw with respect to the wrench body.

According to the monkey wrench in some fifth examples, in addition to the effect provided by the monkey wrench in any one of the first to fourth examples, at least one row among the plurality of rows is arranged such that the plurality of fitting depressed portions are equally spaced along the advancing/retreating direction of the movable jaw. This improves versatility and convenience of the monkey wrench. For example, even in the case where the width-across-flats size of the object to be sandwiched is compliant to a standard to which the respective pitches (spacings) of the fitting depressed portions of the other rows are not adapted, selecting this row where the plurality of fitting depressed portions are equally spaced enhances the possibility that one of the respective fitting depressed portions in this row is adapted, thus enhancing the versatility of the fitting depressed portions. Additionally, the plurality of fitting depressed portions are equally spaced. This allows utilizing the tool width-across-flats size as a scale, thus improving convenience of the fitting depressed portions.

According to the monkey wrench in some sixth examples, in addition to the effect provided by the monkey wrench in any one of the first to fifth examples, the wrench body includes a guide groove depressed in a groove shape on the side surface of the wrench body. The guide groove couples the plurality of fitting depressed portions in at least one row among the plurality of rows. Accordingly, when the movable jaw advances and retreats, this maintains a state where the protrusion and the guide groove fit together even in the position where the protrusion does not fit the fitting depressed portion. That is, even in a state where the tool width-across-flats size is adjusted to a width-across-flats size where the protrusion and the fitting depressed portion do not fit together, this maintains a state where the wrench body and the movable jaw are coupled together via the leaf spring portion. As a result, this reduces rattling of the movable jaw with respect to the wrench body.

The guide groove has the smaller fitting margin when the protrusion is fitted than the fitting margin when the protrusion fits the fitting depressed portion. Accordingly, when the movable jaw advances and retreats, moving the protrusion via the guide groove allows the protrusion to reliably fit each fitting depressed portion using a guiding effect of the guide groove. Additionally, when the movable jaw advances and retreats, the worker can recognize that the protrusion passing through the guide groove reaches the fitting depressed portion. This facilitates the adjustment of the tool width-across-flats size.

According to the monkey wrench in some seventh examples, in addition to the effect provided by the monkey wrench in any one of the first to sixth examples, the leaf spring portion, the protrusion, the plurality of rows, and the positioning unit are each disposed on both side surfaces of one side surfaces of the movable jaw and the wrench body and another side surfaces on an opposite side of the one side surface. This does not only provide the effect of fitting between the protrusion and the fitting depressed portion on both the side surfaces of the wrench body, but also sandwich the wrench body using the pair of leaf spring portions from both sides, thus providing an elastic force of the leaf spring portion effectively acting in a direction to correct the rattling.

According to the monkey wrench in some eighth examples, in addition to the effect provided by the monkey wrench in the seventh examples, a positional relationship between the protrusion on the one side surface and each fitting depressed portion in one row among the plurality of rows is the same as a positional relationship between the protrusion on the other side surface and each fitting depressed portion in one row among the plurality of rows. Accordingly, when the tool width-across-flats size is adjusted, on both side surfaces of the one side surface and the other side surface, this forms a state where the protrusions fit the fitting depressed portions.

This reliably provides the locking function of the tool width-across-flats size. When the movable jaw advances and retreats, on both side surfaces of the one side surface and the other side surface, this simultaneously performs fitting of the protrusions into the fitting depressed portions and releasing. This ensures that the worker recognizes the state (the fitting state or the non-fitting state), thus improving working efficiency of the positioning operation.

According to the monkey wrench in some ninth examples, in addition to the effect provided by the monkey wrench in the seventh or eighth examples, a positional relationship between the protrusion on the one side surface and each fitting depressed portion in one row among the plurality of rows is different from a positional relationship between the protrusion on the other side surface and each fitting depressed portion in one row among the plurality of rows. This provides different fitting states between the protrusion and the fitting depressed portion on the one side surface and the other side surface when the tool width-across-flats size is adjusted. That is, a limited area of the side surface of the wrench body is effectively used to ensure the number of selectable fitting positions (that is, the kind of the width-across-flats size to provide the positioning function and the locking function).

According to the monkey wrench in some tenth examples, in addition to the effect provided by the monkey wrench in any one of the seventh to ninth examples, on the one side surface or the other side surface, each row among the plurality of rows includes the plurality of fitting depressed portions equally spaced from one another along the advancing/retreating direction of the movable jaw, and the spacings are different for each row. This improves versatility and convenience of the monkey wrench. For example, even in the case where the width-across-flats size of the object to be sandwiched is compliant to a standard to which the respective pitches (spacings) of the fitting depressed portions of the other rows are not adapted, selecting any row of the respective tows where the plurality of fitting depressed portions are equally spaced from one another enhances the possibility that one of the respective fitting depressed portions of the row is adapted, thus enhancing the versatility of the fitting depressed portions. Additionally, the plurality of fitting depressed portions are equally spaced. This allows utilizing the tool width-across-flats size as a scale, thus improving convenience of the fitting depressed portions.

According to the monkey wrench in some eleventh examples, in addition to the effect provided by the monkey wrench in any one of the seventh to tenth examples, the wrench body includes a flat surface portion on each of the one side surface and the other side surface. The flat surface portion has a flat surface shape along the advancing/retreating direction of the movable jaw. The positioning unit is configured to position the leaf spring portion in a position where the protrusion is arranged in the flat surface portion on the one side surface and the other side surface. This forms a configuration that advances and retreats the movable jaw in a state where the protrusion does not fit the fitting depressed portion. That is, this allows the worker to adjust the position of the leaf spring portion to select any of the following configurations. Fitting between the protrusion and the fitting depressed portion is used to ensure a configuration that provides the positioning function and the locking function of the width-across-flats size. The protrusion is not fitted to the fitting depressed portion (that is, the protrusion disposed on the flat surface portion) to ensure a configuration that does not provide the positioning function and the locking function of the width-across-flats size.

According to the monkey wrench in some twelfth examples, in addition to the effect provided by the monkey wrench in any one of the seventh to eleventh examples, the wrench body includes a continuous depressed groove on each of the one side surface and the other side surface. The continuous depressed groove is formed to fit the protrusion. The continuous depressed groove continuously extends in a groove shape along the advancing/retreating direction of the movable jaw. The positioning unit is configured to position the leaf spring portion in a position where the protrusion fits the continuous depressed groove on the one side surface and the other side surface. On both side surfaces of the one side surface and the other side surface, in a state where the fitting between the protrusion and the continuous depressed groove is maintained, the configuration allows the movable jaw to advance and retreat. That is, in a state where the tool width-across-flats size is adjusted to any width-across-flats size, the wrench body and the movable jaw maintain a state coupled via the leaf spring portion. As a result, this reduces rattling of the movable jaw with respect to the wrench body.

According to the monkey wrench in some thirteenth examples, in addition to the effect provided by the monkey wrench in any one of the seventh to twelfth examples, a fitting margin between the protrusion and each fitting depressed portion in at least one row among the plurality of rows on the one side surface is different from a fitting margin between the protrusion and each fitting depressed portion in at least one row among the plurality of rows on the other side surface. Accordingly, when the tool width-across-flats size is adjusted, an operational feeling generated by fitting of the protrusion into the fitting depressed portion on the one side surface is different from an operational feeling generated by fitting of the protrusion into the fitting depressed portion on the other side surface. This provides different operational feelings transmitted to the worker. Accordingly, the worker can recognize: a position for positioning the tool width-across-flats size adjusted using the fitting between one row on the one side surface and the protrusion; and a position for positioning the tool width-across-flats size adjusted using the fitting between one row on the other side surface and the protrusion, by a difference in operational feeling.

According to the monkey wrench in some fourteenth examples, in addition to the effect provided by the monkey wrench in the first examples, the leaf spring portion, the protrusion, the plurality of rows, and the positioning unit are each disposed on one side surfaces of the movable jaw and the wrench body. This simply and reliably provides the positioning function when the tool width-across-flats size is adjusted and the locking function of the adjusted width-across-flats size with respect to the width-across-flats sizes of different standards.

In this case, the leaf spring portion is also disposed on the other side surface at the opposite side of the one side surface of the movable jaw. The leaf spring portions on both side surfaces of the one side surface and the other side surface allows sandwiching the wrench body from both sides, thus effectively providing elastic forces to the leaf spring portions in a direction where rattling is corrected.

Additionally, the leaf spring portion is fixedly secured. On the other side surface of the wrench body, the fitting depressed portion is not depressed but at least a region facing a moving trajectory of the leaf spring portion is formed in a flat surface shape. Thus, the leaf spring portion is not necessary to move, and it is not necessary to depress the fitting depressed portion. This reduces the process cost, thus reducing product cost.

According to the monkey wrench in some fifteenth examples, in addition to the effect provided by the monkey wrench in the first examples, the leaf spring portion, the protrusion, the plurality of rows, and the positioning unit are each disposed on one side surfaces of the movable jaw and the wrench body. This simply and reliably provides the positioning function when the tool width-across-flats size is adjusted and the locking function of the adjusted width-across-flats size with respect to the width-across-flats sizes of different standards.

In this case, the leaf spring portion and the protrusion are fixedly secured on another side surface on an opposite side of the one side surface in the movable jaw. A continuous depressed groove is formed to fit the protrusion on the other side surface of the wrench body. The continuous depressed groove continuously extends in a groove shape along the advancing/retreating direction of the movable jaw. Regardless of the state (a fitting state and a non-fitting state) between the protrusion and the fitting depressed portion on the one side surface, on the other side surface, in a state where the fitting of the protrusion into the continuous depressed groove is maintained, the configuration allows the movable jaw to advance and retreat. That is, in a state where the tool width-across-flats size is adjusted to any width-across-flats size, the wrench body and the movable jaw at least on the other side surface maintain a state coupled via the leaf spring portion. As a result, this reduces rattling of the movable jaw with respect to the wrench body.

According to the monkey wrench as defined in some sixteenth examples, in addition to the effect provided by the monkey wrench in the fourtheenth or fifteenth examples, the wrench body includes a guide groove depressed in a groove shape on the one side surface of the wrench body. The guide groove couples the plurality of fitting depressed portions in at least one row among the plurality of rows. The guide groove has a smaller fitting margin when the protrusion is fitted than a fitting margin when the fitting depressed portion fits the protrusion. Accordingly, when the movable jaw advances and retreats, moving the protrusion via the guide groove allows the protrusion to reliably fit each fitting depressed portion using a guiding effect of the guide groove.

Additionally, when the movable jaw advances and retreats, this maintains a state where the protrusion and the guide groove fit together even in the position where the protrusion does not fit the fitting depressed portion. That is, even in a state where the tool width-across-flats size is adjusted to a width-across-flats size where the protrusion and the fitting depressed portion do not fit together, this maintains a state where the wrench body and the movable jaw are coupled together via the leaf spring portion. As a result, this reduces rattling of the movable jaw with respect to the wrench body.

According to monkey wrench in some seventeenth examples, the fitting depressed portions are depressed on one side surface of the wrench body. The protrusion protrudes from the surface facing the side surface of the wrench body in the leaf spring portion formed as the leaf spring that extends from the side surface of the movable jaw. This facilitates the structure while maintaining the fitting between the protrusion and the fitting depressed portion even in the case where rattling of the movable jaw occurs with respect to the wrench body due to deformation and abrasion of the sliding surface. The elastic force of the leaf spring portion acts in a direction to correct the rattling. This reliably provides the positioning function and the locking function.

In this case, the fitting depressed portion is disposed on the one side surface and the continuous depressed groove is disposed on the other side surface. Corresponding to the width-across-flats size of a nut and the like, when the worker moves the movable jaw to adjust the width-across-flats size of the monkey wrench, the effect of guiding the protrusion to the continuous depressed groove on the other side surface allows the protrusion to reliably fit the fitting depressed portion on the one side surface. Additionally, intermittently fitting the protrusion into the fitting depressed portion on the one side surface allows the worker to recognize that the width-across-flats size is adjusted to a predetermined width-across-flats size.

The fitting depressed portion and the continuous depressed groove are separately disposed on the one side surface and the other side surface. Accordingly, in a state where the width-across-flats size of the monkey wrench is adjusted to a width-across-flats size (that is the most heavily used width-across-flats size) where the protrusion fits the fitting depressed portion, on both side surfaces of the one side surface and the other side surface, both protrusions each fit the fitting depressed portion or the continuous depressed groove. Accordingly, both of the one side surface and the other side surface, rigidity of the leaf spring portion can be utilized. As a result, this reliably provides the locking function that prevents positional deviation (such as rattling in a direction to rotate the worm where the movable jaw moves in a direction separating from the wrench) of the movable jaw with respect to the fixed jaw.

According to the monkey wrench in some eighteenth examples, in addition to the effect provided by the monkey wrench in the seventeenth examples, a second side surface in a retreat position with respect to a first side surface is formed only on the one side surfaces of the movable jaw and the wrench body. This avoids inhibition of working efficiency by the leaf spring portion protruding from the side surface of the wrench body while providing the minimum area where the second side surface is disposed to reduce the process cost for depressing the second side surface and suppress decrease in strength of the movable jaw and the wrench body.

That is, on the one side surface, when the movable jaw is moved, the protrusion and the fitting depressed portion are intermittently fitted together. Accordingly, in the case where the monkey wrench is used with the width-across-flats size where the protrusion does not fit the fitting depressed portion, the protrusion rides upon the side surface of the wrench body such that the leaf spring portion protrudes from the side surface of the wrench body. This inhibits working efficiency. Accordingly, forming the second side surface on the one side surface avoids protruding of the leaf spring portion from the side surface of the wrench body, thus improving working efficiency. In this case, on the other side surface, when the movable jaw is moved, a fitting state between the protrusion and the continuous depressed groove is maintained. Thus, the leaf spring portion does not protrude from the side surface of the wrench body. Accordingly, on the other side surface, it is not necessary to form the second side surface. This reduces the process cost for depressing the second side surface and suppresses decrease in strength of the wrench body.

According to the monkey wrench in some nineteenth examples, in addition to the effect provided by the monkey wrench in the eighteenth examples, a retreat amount of the second side surface with respect to the first side surface is set to a dimension value where the leaf spring portion does not protrude from the first side surface in a state where the protrusion rides upon the second side surface of the wrench body. Even in case where the monkey wrench is used with the width-across-flats size where the protrusion does not fit the fitting depressed portion, this reliably avoids inhibition of working efficiency.

DESCRIPTION OF EMBODIMENTS

Figure 1:
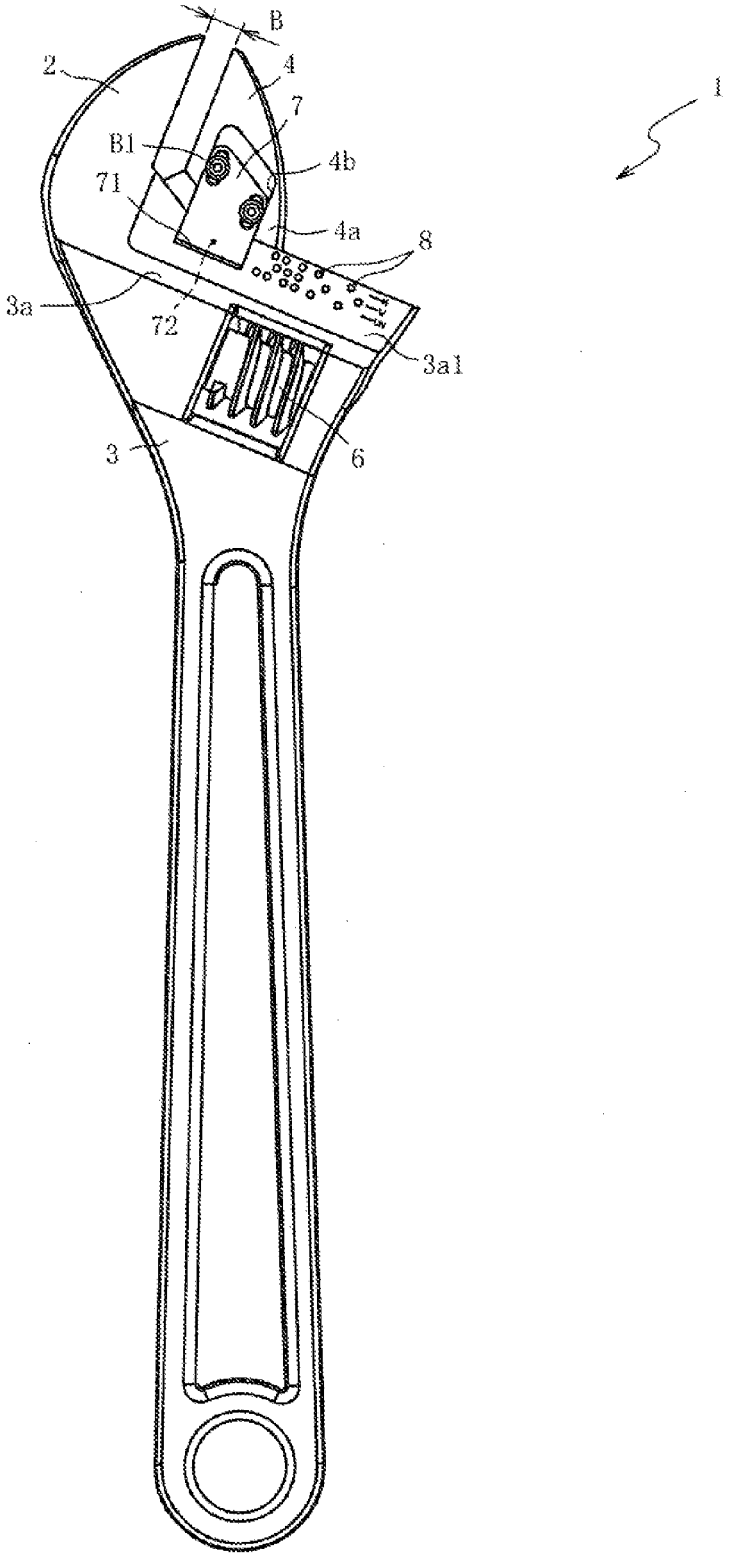
FIG. 1 is a front view of a monkey wrench in a first embodiment of the present invention.
Figure 2B:
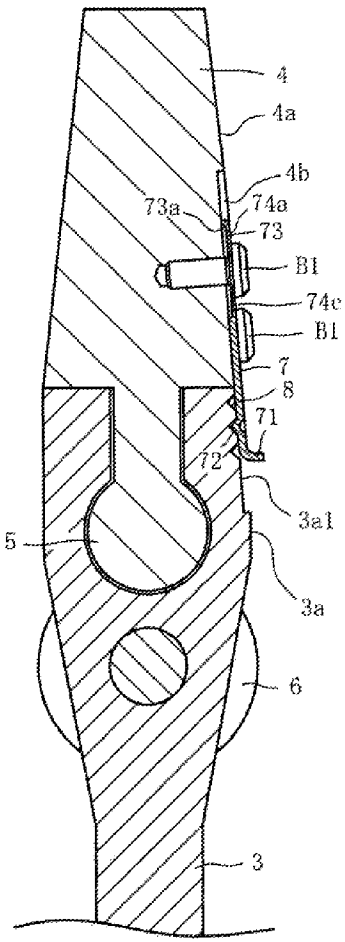
FIG. 2B is a partially enlarged cross-sectional view of the monkey wrench taken along the line IIb-IIb of FIG. 2A.
Figure 2A:
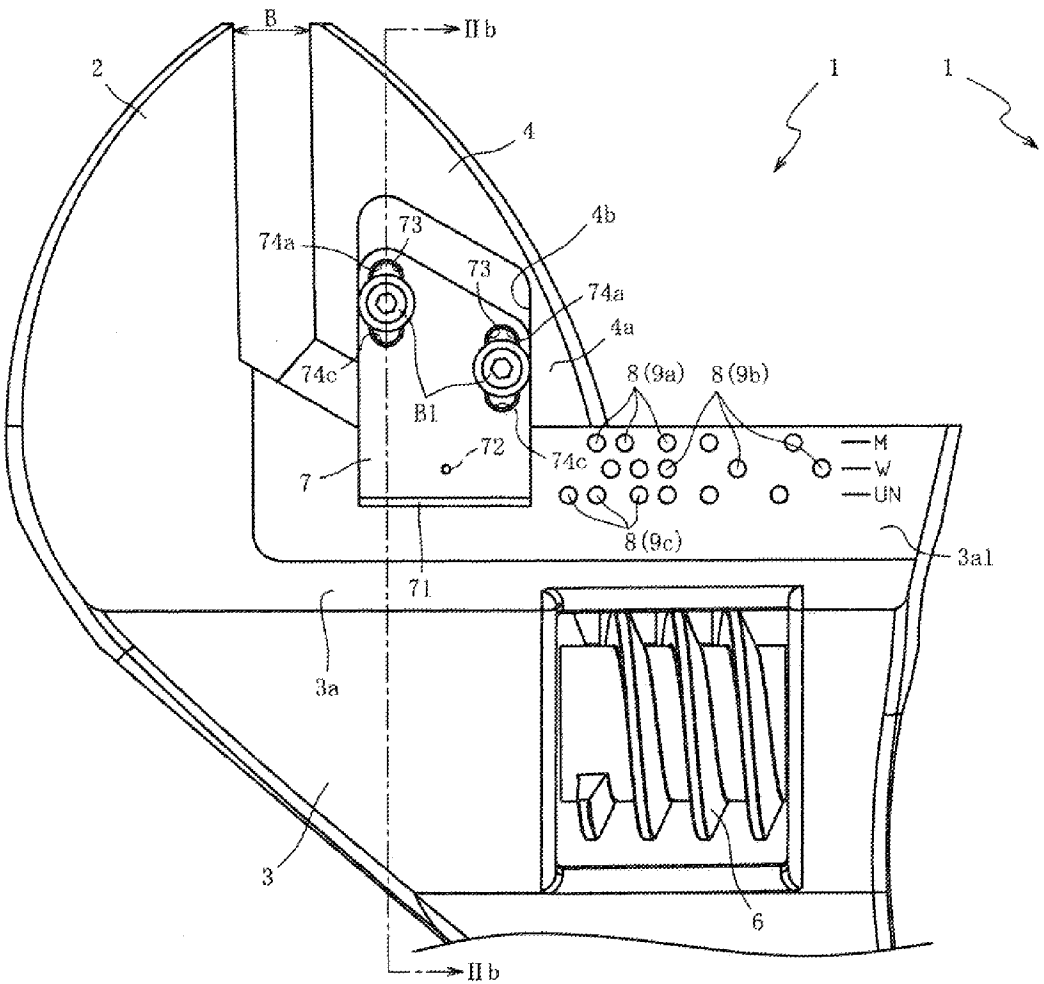
FIG. 2A is a partially enlarged front view of the monkey wrench.

Hereinbelow, preferred embodiments of the present invention will be described with reference to the attached drawings. FIG. 1 is a front view of a monkey wrench 1 in a first embodiment of the present invention. FIG. 2A is a partially enlarged front view of the monkey wrench 1. FIG. 2B is a partially enlarged cross-sectional view of the monkey wrench 1 taken along the line IIb-IIb of FIG. 2A.

As illustrated in FIG. 1 and FIGS. 2A and 2B, the monkey wrench 1 mainly includes a wrench body 3 with a fixed jaw 2, a movable jaw 4, a space adjusting mechanism, and a leaf spring portion 7. The movable jaw 4 is slidably disposed on the wrench body 3 to sandwich an object to be sandwiched such as a nut between the movable jaw 4 and the fixed jaw 2. The space adjusting mechanism advances and retreats the movable jaw 4 with respect to the fixed jaw 2 to adjust a tool width-across-flats size B. The leaf spring portion 7 is movably attached to a side surface 4*a* of the movable jaw 4.

The space adjusting mechanism is constituted by a rack 5 and a worm 6. The rack 5 is formed on the movable jaw 4. The worm 6 is turnably disposed on the wrench body 3 in a position engaging the rack 5. This worm 6 is rotated by an operation of a worker such that the rack 5 moves linearly. Accordingly, the movable jaw 4 advances and retreats in approaching and separating directions (a right-left direction of FIG. 2A) with respect to the fixed jaw 2.

The wrench body 3 has a side surface 3*a* where a second side surface 3*a*1 is partially depressed. The second side surface 3*a*1 is a flat surface formed in a range that includes at least a moving trajectory when the leaf spring portion 7 moves in association with the advancing and retreating of the movable jaw 4. The second side surface 3*a*1 is positioned backward with respect to the side surface 3*a* (that is, at a far-side in the paper of FIG. 2A).

On the second side surface 3*a*1, a plurality of fitting depressed portions 8 are depressed. The plurality of fitting depressed portions 8 are disposed in a straight line along the advancing/retreating direction (the right-left of FIG. 2A) of the movable jaw 4 to form a plurality (three in this embodiment) of rows 9*a* to 9*c*. The rows 9*a* to 9*c* are spaced from one another in a direction (a top-bottom direction in FIG. 2A) perpendicular to the advancing/retreating direction of the movable jaw 4 and are parallel to one another. A detailed configuration of the rows 9*a* to 9*c* will be described below.

On the side surface 4*a* of the movable jaw 4, a fitting groove 4*b* is depressed. The fitting groove 4*b* is a depressed groove with a U-shaped cross section where the leaf spring portion 7 is internally mounted. The fitting groove 4*b* has approximately the same depth dimension as a plate thickness dimension of the leaf spring portion 7, and extends along a direction perpendicular to the advancing/retreating direction (the top-bottom direction in FIG. 2A) of the movable jaw 4. That is, the fitting groove 4*b* includes a pair of opposing inner wall surfaces (inner wall surfaces on the left side and the right side in FIG. 2A) parallel to one another. The inner wall surfaces are formed as flat surfaces perpendicular to the advancing/retreating direction the movable jaw 4.

The fitting groove 4*b* includes a bottom surface (a far-side surface in the paper of FIG. 2A) formed parallel to and on the same plane as that of the second side surface 3*a*1 of the wrench body 3. That is, in a state where the movable jaw 4 is disposed in a regular position with respect to the wrench body 3, the bottom surface of the fitting groove 4*b* and the second side surface 3*a*1 of the wrench body 3 are positioned on the same plane (see FIG. 2B). On the bottom surface of the fitting groove 4*b*, a fastening hole is depressed. A fastening bolt B1 is fastened to the fastening hole.

The side surface 4*a* of the movable jaw 4 and the side surface 3*a* of the wrench body 3 correspond to a portion viewed in a front view of the monkey wrench 1 (that is, in a state illustrated in FIG. 1 and FIG. 2A). "The side surface of the movable jaw" and "the side surface of the wrench body" described in the claims have the similar meaning. This meaning is similar in each embodiment below. Therefore, it will not be further elaborated here.

The leaf spring portion 7 is a member formed as a leaf spring using a metallic plate-shaped body. In the leaf spring portion 7, a base end side (an upper side in FIG. 2A) is fastened and secured to the side surface 4*a* (the bottom surface of the fitting groove 4*b*) of the movable jaw 4 by the fastening bolt B1, and a distal end side (a lower side in FIG. 2A) is disposed facing the side surface 3*a* of the wrench body 3. The distal end side elastically deforms (flexurally deforms) in approaching and separating directions (a right-left direction in FIG. 2B) with respect to the side surface 3*a* of the wrench body 3. Here, by referring to FIGS. 3A and 3B to FIGS. 5A and 5B, the detailed configuration of the leaf spring portion 7 will be described.

Figure 3B:
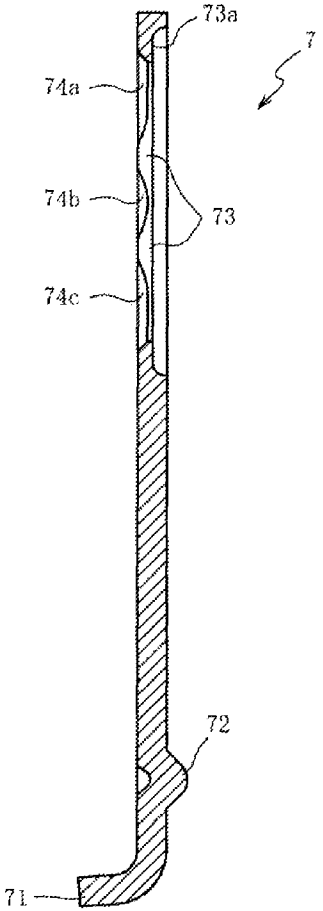
FIG. 3B is a cross-sectional view of the leaf spring portion taken along the line IIIb-IIIb of FIG. 3A.
Figure 3A:
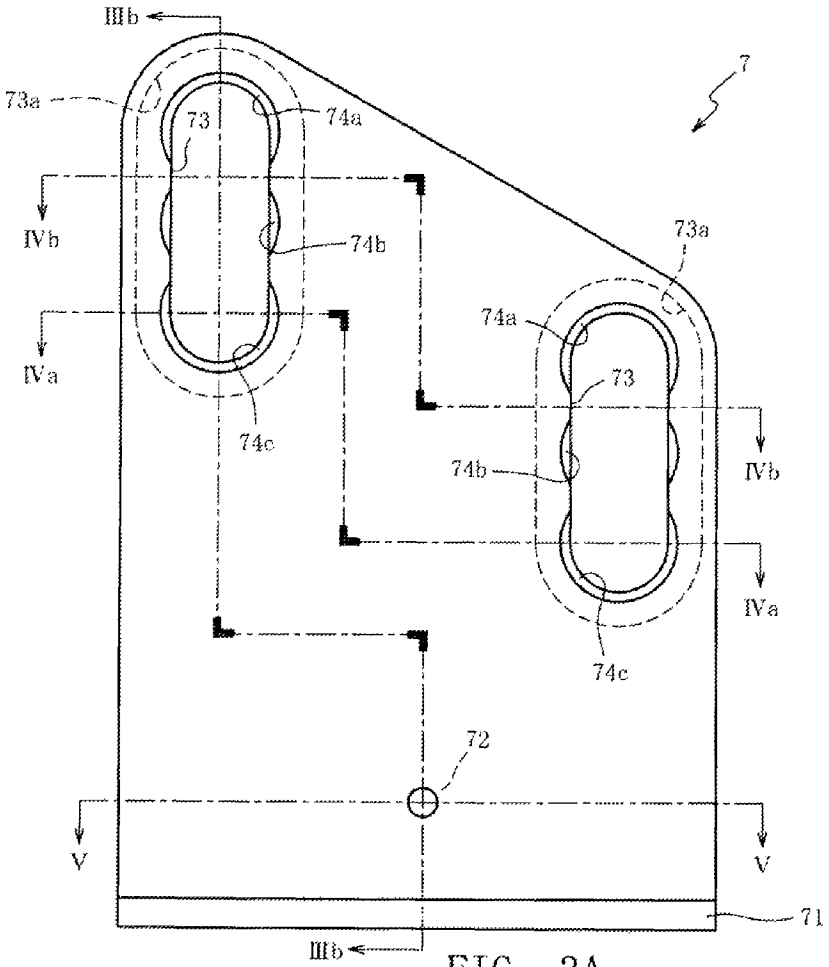
FIG. 3 is a front view of the leaf spring portion.
Figure 4A:
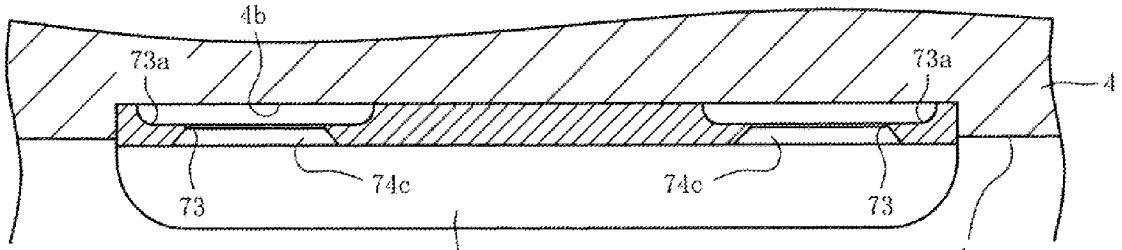
FIG. 4A and FIG. 4B are cross-sectional views of the leaf spring portion taken along the line IVa-IVa of FIG. 3A.

FIG. 3A is a front view of the leaf spring portion 7. FIG. 3B is a cross-sectional view of the leaf spring portion 7 taken along the line IIIb-IIIb of FIG. 3A. FIG. 4A and FIG. 4C are cross-sectional views of the leaf spring portion 7 taken along the line IVa-IVa of FIG. 3A.

Figure 4B:
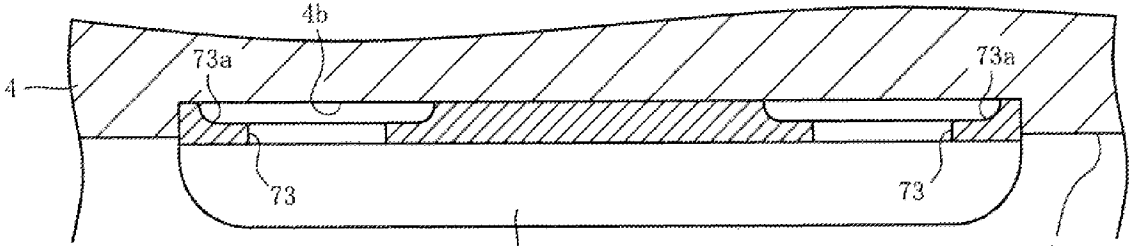
Figure 4C:
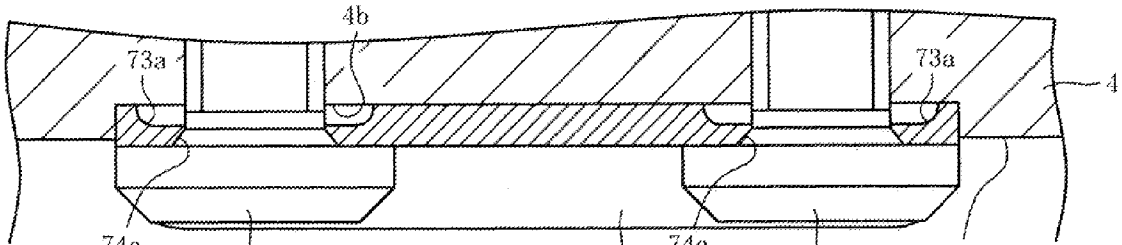
Figure 5A:
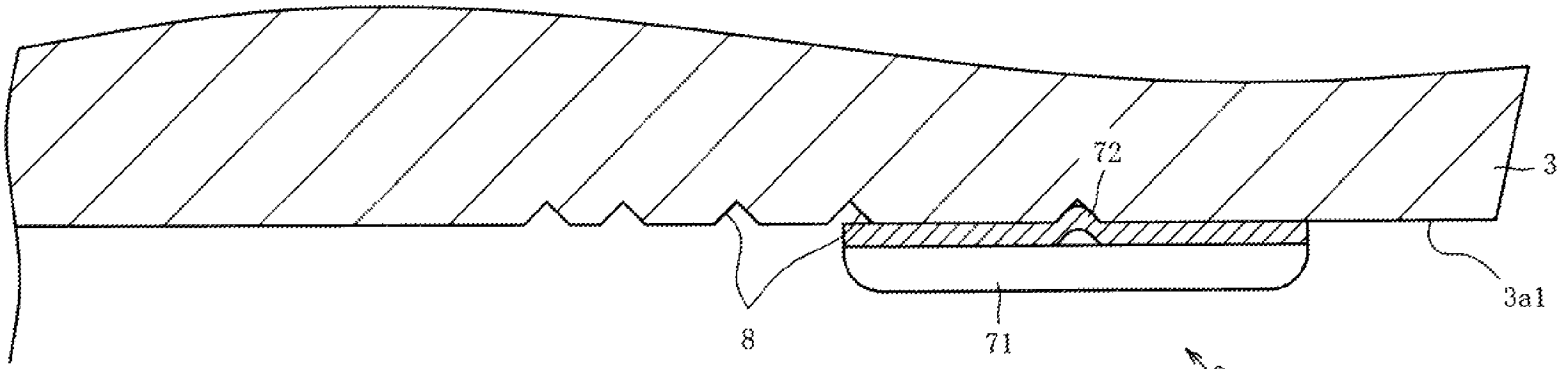
FIG. 5A and FIG. 5B are cross-sectional views of the leaf spring portion 7 taken along the line V-V of FIG. 3A.
Figure 5B:
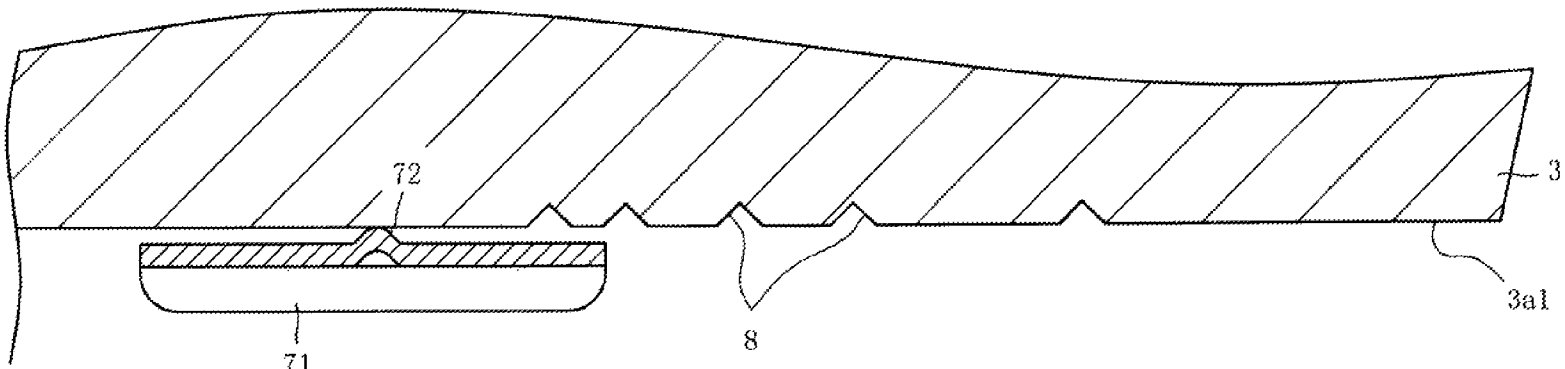

FIG. 4B is a cross-sectional view of the leaf spring portion 7 taken along the line IVb-IVb of FIG. 3A. FIG. 5A and FIG. 5B are cross-sectional views of the leaf spring portion 7 taken along the line V-V of FIG. 3A.

FIG. 4A to FIG. 4C illustrate cross-sectional views where the leaf spring portion 7 is mounted on the inner side of the fitting groove 4*b* of the movable jaw 4. FIG. 4C illustrates a cross-sectional view where the leaf spring portion 7 is fastened and secured to the movable jaw 4 by the fastening bolt B1. Additionally, FIG. 5A illustrates a cross-sectional view where the protrusion 72 of the leaf spring portion 7 fits the fitting depressed portion 8 of the wrench body 3. FIG. 5B illustrates a cross-sectional view where the protrusion 72 of the leaf spring portion 7 rides upon the second side surface 3*a*1 of the wrench body 3.

The leaf spring portion 7 is a plate-shaped body mounted on the inner side of the fitting groove 4*b* that is depressed on the side surface 4*a* of the movable jaw 4, and includes a grip portion 71, the protrusion 72, an insertion hole 73, and chamfered portions 74*a* to 74*c*. In this embodiment, press forming is performed on a sheet-shaped material to form the leaf spring portion 7.

The leaf spring portion 7 has right and left side surfaces (side surfaces on the right and left sides in FIG. 3A) formed parallel to each other. A dimension between the side surfaces on the right and left sides that is a width dimension (a right-left dimension in FIG. 3A) is the same or slightly decreased compared with a spacing (a right-left dimension in FIG. 2A) between the inner wall surfaces facing one another in the fitting groove 4*b* of the movable jaw 4.

The grip portion 71 is a portion to assist a gripping operation of a worker when a position of the leaf spring portion 7 is adjusted. An edge portion at one end side (a lower side in FIG. 3A) of the plate-shaped body constituting the leaf spring portion 7 is formed by folding to an opposite side of a protruding direction (rightward in FIG. 3B) of the protrusion 72. Accordingly, in a product state, the grip portion 71 protrudes from the second side surface 3*a*1 of the wrench body 3 (see FIG. 2B). Therefore, in the case where a worker adjusts the position of the leaf spring portion 7, using the grip portion 71 facilitates applying a force to the leaf spring portion 7 when the leaf spring portion 7 is adjusted in any direction (the top-bottom direction of FIG. 2A).

The protrusion 72 is a portion that protrudes in an approximately hemispherical shape from one surface (a surface facing the second side surface 3*a*1 of the wrench body 3, which is the right side surface in FIG. 3B) of the plate-shaped body constituting the leaf spring portion 7. In this embodiment, the protrusion 72 is formed by press work that presses a punch from the other surface of the plate-shaped body to partially project the plate-shaped body from one surface.

However, a separate component may be firmly fixed to the plate-shaped body by welding and bonding to form the protrusion 72. The method using the press work ensures dimension accuracy of the protrusion 72, thus improving position accuracy of the movable jaw 4 with respect to the fixed jaw 2. Conversely, the method using welding and bonding reduces the number of components and assembling man-hours, thus reducing product cost compared with a conventional product in a ball plunger type.

The protrusion 72 has a hemispherical outline formed in a size that allows fitting to the fitting depressed portion 8 depressed on the second side surface 3*a*1 of the wrench body 3. In a state where the protrusion 72 fits the fitting depressed portion 8, one surface of the plate-shaped body constituting the leaf spring portion 7 is brought into contact with the second side surface 3*a*1 of the wrench body 3 (or faces the second side surface 3*a*1 parallel having a slight gap) (see FIG. 5A). In a state where the protrusion 72 rides upon the second side surface 3*a*1 of the wrench body 3 and does not fit the fitting depressed portion 8, the plate-shaped body constituting the leaf spring portion 7 is elastically warped by a protruding height of the protrusion 72 (see FIG. 5B).

The insertion hole 73 is an elongated hole that passes through an oval-like shape (a shape where two semicircles are connected by straight lines) from a front view. A pair of straight-line portions are formed parallel to the right and left side surfaces (the side surfaces on the left side and the right side in FIG. 3A) of the leaf spring portion 7.

On one surface (a surface in contact with the bottom surface of the fitting groove 4*b* of the movable jaw 4, which is a far-side surface in the paper of FIG. 3A) of the plate-shaped body constituting the leaf spring portion 7, the depression portion 73*a* in a larger oval-like shape from a front view than the outline of the insertion hole 73 is depressed in a peripheral area of the insertion hole 73.

This depression portion 73*a* forms a gap (a space) between the leaf spring portion 7 and the bottom surface of the fitting groove 4*b*, and ensures a partially small thickness dimension (a dimension in a top-bottom direction of FIG. 4A) of the plate-shaped body in the peripheral area of the insertion hole 73, thus decreasing rigidity. This elastically deforms the peripheral area of the insertion hole 73 to move the leaf spring portion 7.

The chamfered portions 74*a* to 74*c* are formed on the other surface (a surface on the opposite side of the surface where the depression portion 73*a* is depressed, which is a near-side surface in the paper of FIG. 3A) of the plate-shaped body constituting the leaf spring portion 7. The chamfered portions 74*a* to 74*c* are portions formed by chamfering (counter boring) of an opening peripheral edge portion of the insertion hole 73, and are formed as conical holes in circular shapes from a front view that gradationally reduce their inner diameters toward a side closer to the depression portion 73*a* side.

In the case where the leaf spring portion 7 is mounted on the inner side of the fitting groove 4*b* of the movable jaw 4 and is fastened and secured by the fastening bolt B1, the conical portion (the conical portion in communication with the seating face) formed at a shaft portion of the fastening bolt B1 engages the chamfered portions 74*a* to 74*c* (see FIG. 4C). This positions the leaf spring portion 7 in a predetermined position, and prevents positional deviation of the leaf spring portion 7 in each positioned position.

In this embodiment, the chamfered portion 74*a* and the chamfered portion 74*c* are formed in a position concentrically with the semicircle in the oval-like shape from a front view of the insertion hole 73. The chamfered portion 74*b* is formed to have the center in a position that is the center in the longitudinal direction (a top-bottom direction in FIG. 3A) and the center in the width direction (a right-left direction in FIG. 3A) of the oval-like shape from a front view of the insertion hole 73. These chamfered portions 74*a* to 74*c* are formed as conical holes in the same size.

In the case where the conical portion formed in the shaft portion of the fastening bolt B1 engages the chamfered portion 74*a*, the leaf spring portion 7 is positioned in a position (that is, a position where the protrusion 72 can fit each fitting depressed portion 8 in the row 9*c*) corresponding to the row 9*c*. In the case where the conical portion engages the chamfered portion 74*b*, the leaf spring portion 7 is positioned in a position (that is, a position where the protrusion 72 can fit each fitting depressed portion 8 in the row 9*b*) corresponding to the row 9*b*. In the case where the conical portion engages the chamfered portion 74*c*, the leaf spring portion 7 is positioned in a position (that is, a position where the protrusion 72 can fit each fitting depressed portion 8 in the row 9*a*) corresponding to the row 9*a* (see FIG. 2A).

Returning to FIG. 1 and FIGS. 2A and 2B, a description will be given of the rows 9*a* to 9*c* formed on the second side surface 3*a*1 of the wrench body 3. The protrusion 72 of the leaf spring portion 7 fits any of the fitting depressed portions 8 constituting the rows 9*a* to 9*c* such that the monkey wrench 1 provides a positioning function during adjusting the tool width-across-flats size B and a locking function of the width-across-flats size B. The rows 9*a* to 9*c* are formed corresponding to respective different standards.

That is, in this embodiment, respective pitches (spacings in the right-left direction of FIG. 2A) of the fitting depressed portions 8 are set to a pitch compliant to the metric thread standard in the row 9*a*, set to a pitch compliant to the Whitworth screw thread standard in the row 9*b*, and set to a pitch compliant to the unified thread standard in the row 9*c*.

Specifically, in this embodiment, the row 9*a* and the row 9*b* are each formed of the five fitting depressed portions 8. The five fitting depressed portions 8 constituting the row 9*a* are arranged in pitches to adjust the tool width-across-flats size B to 16 mm, 18 mm, 21 mm, 24 mm, and 30 mm corresponding to respective heads of screws with nominal diameters of M10, M12, M14, M16, and M20. The five fitting depressed portions 8 constituting the row 9*b* are arranged in pitches to adjust the tool width-across-flats size B to 17 mm, 19 mm, 21 mm, 26 mm, and 32 mm corresponding to respective heads of screws with nominal diameters of W3/8, W7/16, W1/2, W5/8, and W3/4. Conversely, the row 9*c* is formed of six fitting depressed portions 8. The six fitting depressed portions 8 are arranged in pitches to adjust the tool width-across-flats size B to 14 mm, 16 mm, 19 mm, 21 mm, 24 mm, and 29 mm corresponding to respective heads of screws with nominal diameters of UNC3/8, UNC1/16, UNC1/2, UNC9/16, UNC5/8, and UNC3/4.

A description will be given of a method for using the monkey wrench 1 constituted as described above by referring to FIG. 1 to FIGS. 5A and 5B. When the monkey wrench 1 is used, first, a position of the leaf spring portion 7 is adjusted corresponding to the standard of the object to be sandwiched as an operating target (that is, corresponding to a selected row among the rows 9*a* to 9*c*).

For example, in the case where a state illustrated in FIG. 2A (that is, a state where the row 9*b* is selected) is switched to a state where the row 9*a* is selected, the leaf spring portion 7 is pushed up (to the upper side in FIG. 2A). Accordingly, the conical portion formed in the shaft portion of the fastening bolt B1 engages the chamfered portion 74*c*. Subsequently, the leaf spring portion 7 is positioned in a position corresponds to the row 9*a* (see FIG. 4C). This allows the protrusion 72 to fit each fitting depressed portion 8 in the row 9*a*. The leaf spring portion 7 may be moved after the fastening bolt B1 is loosened.

In this case, the leaf spring portion 7 is mounted on the inner side of the fitting groove 4*b* of the movable jaw 4. The right and left inner wall surfaces of the fitting groove 4*b* guide the movement of the leaf spring portion 7 in one direction. This streamlines a position adjusting operation of the leaf spring portion 7.

The chamfered portions 74*a* to 74*c* are formed at spaces from one another (that is, a portion that is not chamfered is left in respective adjacent spaces). Accordingly, when the leaf spring portion 7 moves along the fitting groove 4*b*, the conical portion formed in the shaft portion of the fastening bolt B1 intermittently engages the respective chamfered portions 74*a* to 74*c*. This allows the worker to easily recognize that the leaf spring portion 7 reaches a predetermined position.

Especially, the chamfered portion 74*a* and the chamfered portion 74*c* are formed in the end portion (that is, concentrically with the semicircle in the oval-like shape from a front view) of the insertion hole 73. Movement of the leaf spring portion 7 until the end portion of the insertion hole 73 is brought in contact with the shaft portion of the fastening bolt B1 allows the leaf spring portion 7 to reach the positions where the chamfered portion 74*a* and the chamfered portion 74*c* can be used. Accordingly, it is not necessary to stop the leaf spring portion 7 in the middle. In this respect, this also streamlines the position adjusting operation.

After the position of the leaf spring portion 7 is adjusted, subsequently, a rotating operation of the worm 6 advances and retreats the movable jaw 4 to adjust the tool width-across-flats size B to the dimension corresponding to the object to be sandwiched. That is, the worker confirms a size of the object to be sandwiched by visual observation, and then rotates the worm 6 to move the movable jaw 4 near a position to form a target width-across-flats size B. If the movable jaw 4 reaches the position to form the target width-across-flats size B, the protrusion 72 of the leaf spring portion 7 fits a predetermined fitting depressed portion 8 in the row 9*a* (see FIGS. 5A and 5B). This provides the positioning function, thus quickly and accurately adjusting the width-across-flats size B. Additionally, in a state where the protrusion 72 fits the fitting depressed portion 8, the wrench body 3 and the movable jaw 4 are coupled together via the leaf spring portion 7. This provides the locking function to prevent variation in adjusted width-across-flats size B.

As described above, with the monkey wrench 1, the wrench body 3 includes a plurality (in this embodiment, three rows) of the rows 9*a* to 9*c* formed of the plurality of fitting depressed portions 8 parallel to one another at spaces in a direction perpendicular to the advancing/retreating direction of the movable jaw 4 (in the top-bottom direction of FIG. 2A). Respective pitches of the fitting depressed portions 8 in these rows 9*a* to 9*c* are set compliant to respective different standards.

Accordingly, corresponding to the standard of the object to be sandwiched, selecting the rows 9*a* to 9*c* to be used (that is, adjusting the position of the leaf spring portion 7 in a position where the protrusion 72 can fit the fitting depressed portion 8 in selected row among the rows 9*a* to 9*c*) ensures compliance to the width-across-flats sizes B of different standards. Further, a positioning unit (the chamfered portions 74*a* to 74*c*) for positioning the leaf spring portion 7 is formed in the leaf spring portion 7. This simply and reliably positions the leaf spring portion 7 in the position where the protrusion 72 can fit the selected row among the rows 9*a* to 9*c*.

That is, the monkey wrench 1 simply and reliably provides the positioning function when the tool width-across-flats size B is adjusted and the locking function of the adjusted width-across-flats size B with respect to the width-across-flats sizes B of different standards.

While the leaf spring portion 7 is mounted on the inner side of the fitting groove 4*b* depressed on the movable jaw 4, the right and left inner wall surfaces of the fitting groove 4*b* extends to the direction perpendicular to the advancing/retreating direction of the movable jaw 4. The right and left inner wall surfaces are constituted to restrict movement of the leaf spring portion 7 in the advancing/retreating direction of the movable jaw 4. When the object to be sandwiched is sandwiched between the fixed jaw 2 and the movable jaw 4 to perform fastening and loosening operations, this minimizes a component force (approximately zero) in a moving direction (in the top-bottom direction of FIG. 2A) of the leaf spring portion 7 along the fitting groove 4*b* among reactive forces acting on the leaf spring portion 7 from the inner wall surfaces of the fitting groove 4*b*. As a result, this reduces displacement of the position of the leaf spring portion 7 by the reactive forces from the inner wall surfaces of the fitting groove 4*b* during the fastening or loosening operation.

Figure 6:
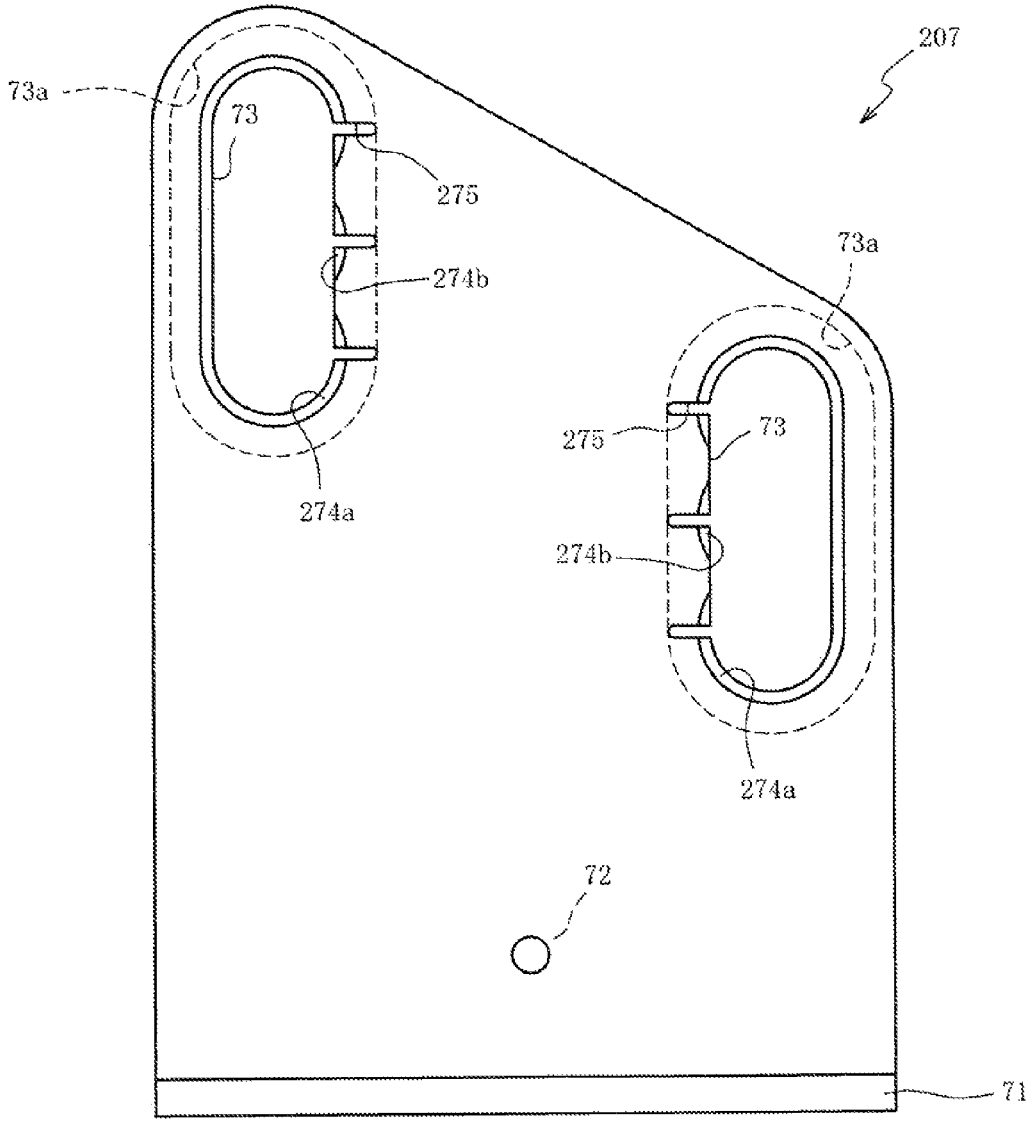
FIG. 6 is a front view of the leaf spring portion of the second embodiment.

Next, the second embodiment will be described with reference to FIG. 6. FIG. 6 is a front view of a leaf spring portion 207 of a second embodiment. Same reference numerals are given to the parts same to those of the first embodiment, and descriptions thereof are omitted.

The leaf spring portion 207 of the second embodiment is different from the leaf spring portion 7 of the first embodiment only in that the chamfered portions 74*a* to 74*c* (see FIGS. 3A and 3B) are replaced by chamfered portions 274*a* and 274*b* and that the slit portion 275 is newly disposed. The second embodiment is otherwise similar to the first embodiment. Therefore, only different points will be described below.

As illustrated in FIG. 6, the chamfered portions 274*a* and 274*b* are portions formed by chamfering (counter boring) of an opening peripheral edge portion of the insertion hole 73, similarly to the chamfered portions 74*a* to 74*c* (see FIGS. 3A and 3B) of the first embodiment, and are formed as conical holes in circular shapes from a front view that gradationally reduce their inner diameters toward a side closer to the depression portion 73*a* side. However, regarding the chamfered portions 274*a* and 274*b*, a portion corresponding to a straight-line portion at one side (a side close to right and left side surfaces of the leaf spring portion 207) of the insertion hole 73 in an oval-like shape from a front view is continuously formed. In this embodiment, for convenience of explanation, this continuous portion will be described as the chamfered portion 274*a*.

That is, the chamfered portions 274*a* and 274*b* are formed as follows. Compared with the chamfered portions 74*a* to 74*c* of the first embodiment, only a portion corresponding to the straight-line portions at one side in the oval-like shape from a front view of the insertion hole 73 have shapes of straight continuous lines between the chamfered portion 74*a* and the chamfered portion 74*b* and between the chamfered portion 74*b* and the chamfered portion 74*c*.

A portion corresponding to the straight-line portion at the other side (the opposite side of the right and left side surfaces of the leaf spring portion 207) in the oval-like shape from a front view of the insertion hole 73 includes a plurality (in this embodiment, three for each insertion hole 73) of slit portions 275. The respective slit portions 275 are cutouts that extend in slit shapes with small widths from an inner edge of the insertion hole 73. The slit portion 275 extends in a straight line along a width direction (a right-left direction of FIG. 6) of the leaf spring portion 207, and then extends to an outer edge of the depression portion 73*a* while separating the respective chamfered portions 274*a* and 274*b* from each other.

In the case where the leaf spring portion 207 is mounted on the inner side of the fitting groove 4*b* of the movable jaw 4 and is fastened and secured by the fastening bolt B1, the conical portion (see FIG. 4C) formed in the shaft portion of the fastening bolt B1 engages the chamfered portions 274*a* and 274*b* (especially, portions at a side where the slit portion 275 is formed). This allows positioning of the leaf spring portion 207 to the predetermined position, and prevents positional deviation of the leaf spring portion 207 in each positioned position.

On the other hand, when the leaf spring portion 207 moves along the fitting groove 4*b* (see FIG. 2), a conical portion formed in the shaft portion of the fastening bolt B1 rides upon a portion where the chamfered portions 274*a* and 274*b* are not formed to move to the adjacent chamfered portions 274*a* and 274*b*.

In this case, the leaf spring portion 207 provides an effect of thinning the thickness dimension of the plate-shaped body by the depression portion 73*a*, in addition, provides an effect of disposing the slit portion 275. This facilitates elastic deformation in the peripheral area of the insertion hole 73. Additionally, at a side where the slit portion 275 is not disposed, the chamfered portions 274*a* and 274*b* are continuously formed in a straight line. This allows the fastening bolt B1 to move without elastic deformation in the peripheral area of the insertion hole 73. Therefore, this allows smoothly moving the leaf spring portion 207 (position adjustment of the worker).

The leaf spring portion 207 in the second embodiment is formed by cutting work of a plate-shaped material. That is, the leaf spring portion 207 is formed in an easily deformable shape at one side of the peripheral area of the insertion hole 73 as described above. The peripheral area of the insertion hole 73 has, at the other side, the shape that does not need to be deformed when the fastening bolt B1 moves. This allows forming a member with high rigidity from a thick plate-shaped material.

Figure 7:
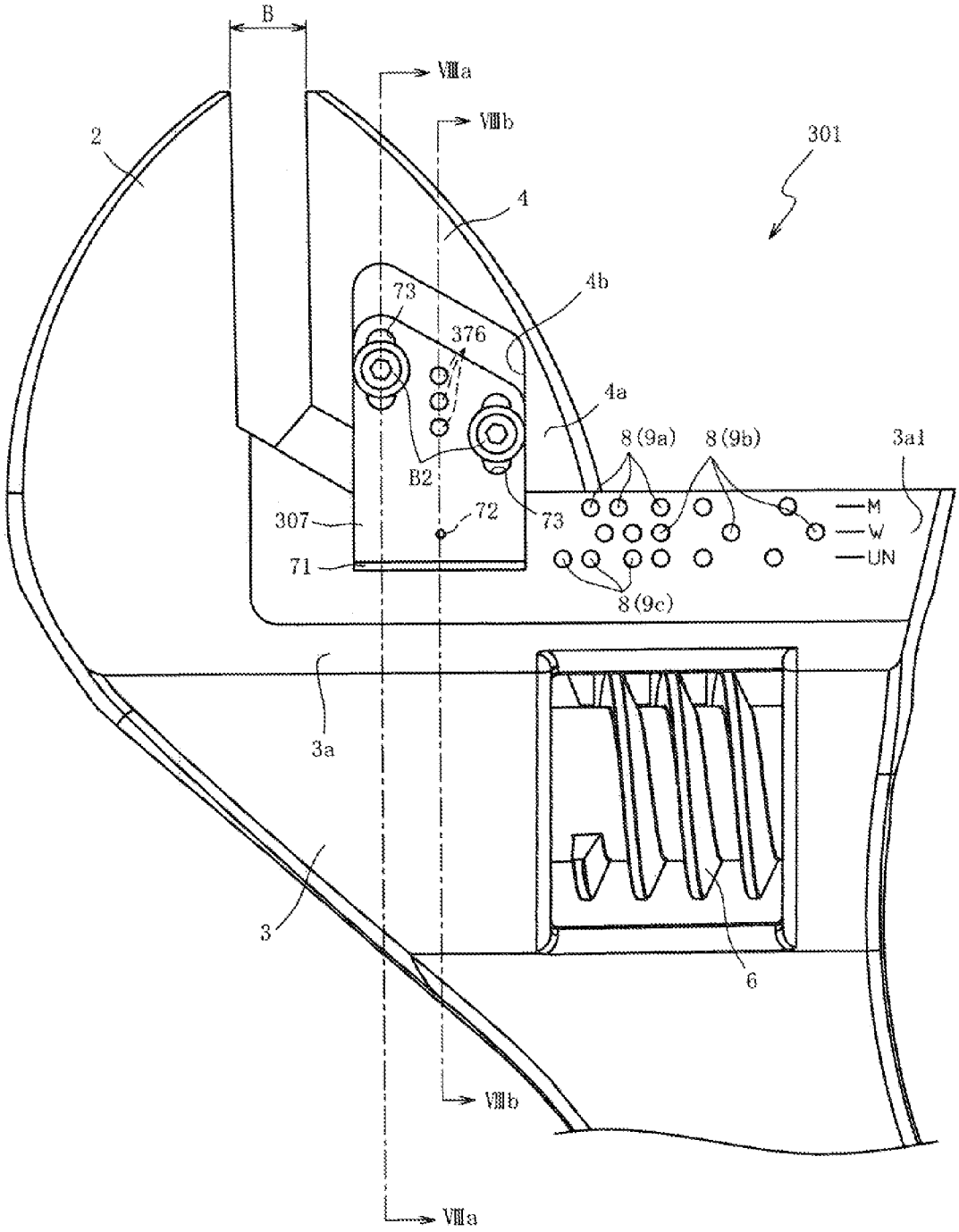
FIG. 7 is a partially enlarged front view of the monkey wrench according to a third embodiment.
Figure 8A:
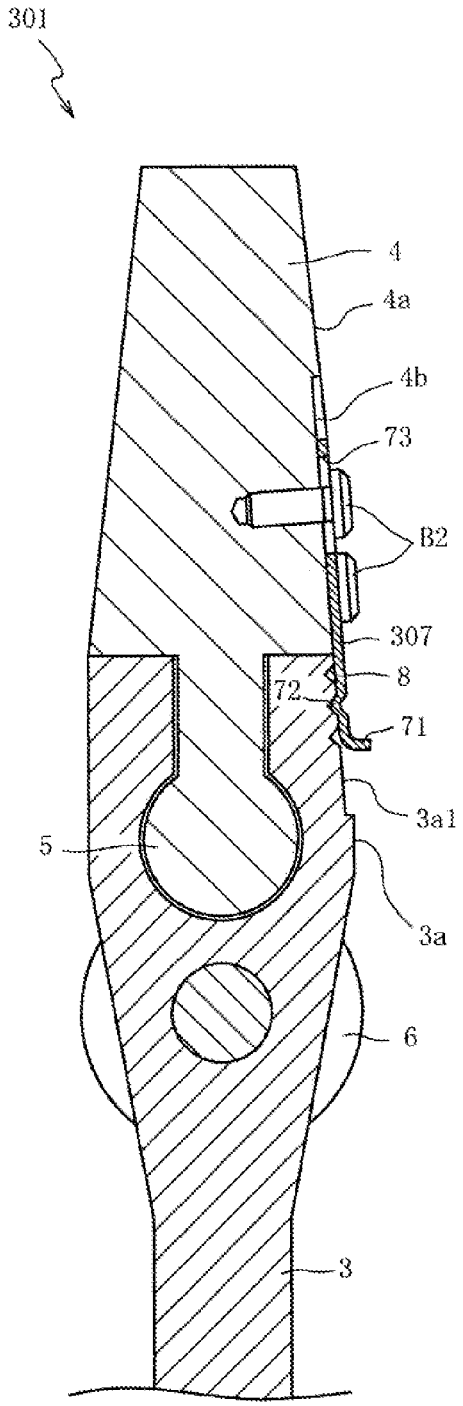
FIG. 8A is a partially enlarged cross-sectional view of the monkey wrench taken along the line VIIIa-VIIIa of FIG. 7.
Figure 8B:
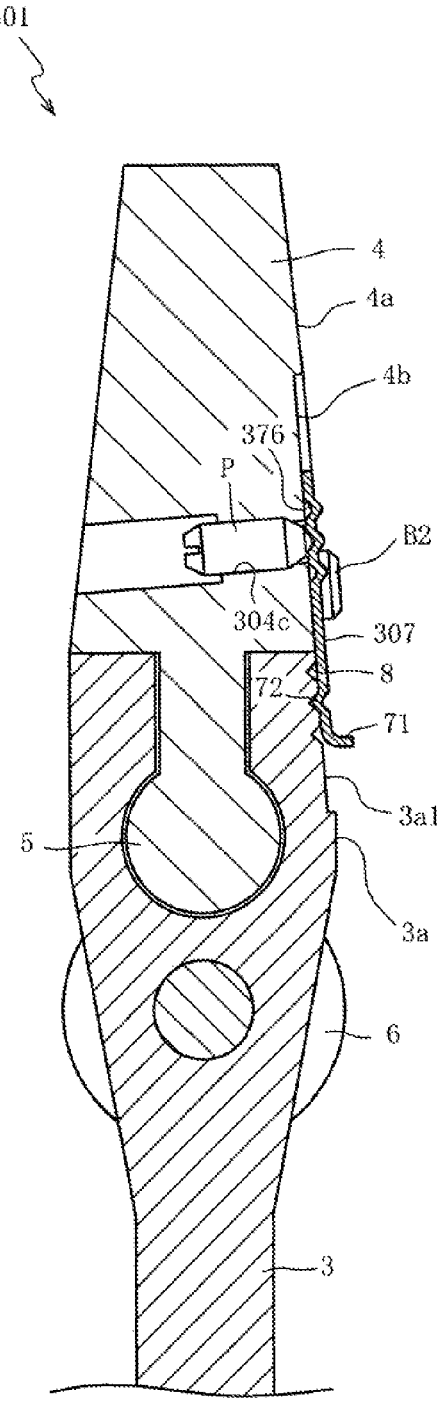
FIG. 8B is a partially enlarged cross-sectional view of the monkey wrench taken along the line VIIIb-VIIIb of FIG. 7.

Next, the third embodiment will be described with reference to FIGS. 7 and 8. FIG. 7 is a partially enlarged front view of a monkey wrench 301 according to a third embodiment. FIG. 8A is a partially enlarged cross-sectional view of the monkey wrench 301 taken along the line VIIIa-VIIIa of FIG. 7. FIG. 8B is a partially enlarged cross-sectional view of the monkey wrench 301 taken along the line VIIIb-VIIIb of FIG. 7. FIG. 8A and FIG. 8B each illustrate a state where the protrusion 72 of the leaf spring portion 307 fits the fitting depressed portion 8.

While in the first embodiment a case where engagement of the chamfered portions 74*a* to 74*c* in the leaf spring portion 7 with the fastening bolt B1 is used for positioning and locking the leaf spring portion 7 has been described, the leaf spring portion 307 according to the third embodiment performs positioning and locking with a ball plunger P. Same reference numerals are given to the parts same to those of each embodiment above, and descriptions thereof are omitted.

The leaf spring portion 307 of the third embodiment is different from the leaf spring portion 7 of the first embodiment only in that formation of the depression portion 73*a* and the chamfered portions 74*a* to 74*c* (see FIGS. 3A and 3B) are omitted and that a positioning depressed portion 376 is newly disposed. The third embodiment is otherwise similar to the first embodiment. Additionally, a fastening bolt B2 is different from the fastening bolt B1 of the first the embodiment only in that the conical portion (the conical portion in communication with the seating face) formed in the shaft portion is omitted (that is, the fastening bolt B2 has a constant outer diameter of the shaft portion from the seating face to the external thread portion). The fastening bolt B2 is otherwise similar to the fastening bolt B1. Therefore, hereinafter, only the different points will be described.

As illustrated in FIG. 7 and FIGS. 8A and 8B, the leaf spring portion 307 includes a plurality (in this embodiment, three) of positioning depressed portions 376 between a pair of insertion holes 73. The plurality of positioning depressed portions 376 are depressed portions into which a ball of the ball plunger P fits. The positioning depressed portions 376 are arranged in a straight line along a direction (a top-bottom direction of FIG. 7) perpendicular to the advancing/retreating direction of the movable jaw 4, and depressed on one surface (a surface at a side in contact with the bottom surface of the fitting groove 4*b* of the movable jaw 4, which is a left side surface of FIG. 8B) of a plate-shaped body constituting the leaf spring portion 307. In this embodiment, the positioning depressed portion 376 with approximately a hemispherical space is formed by press work that presses a punch from one surface of the plate-shaped body to partially depress a depressed portion on the plate-shaped body.

The ball plunger P is buried in the movable jaw 4 in a state where the ball at the distal end protrudes to fit the positioning depressed portion 376 of the leaf spring portion 307. In the ball plunger P, a coil spring is disposed in an elastically compressed state. An elastic restoring force of the coil spring biases the ball at the distal end to the protruding direction. The ball plunger P is firmly fixed to the movable jaw 4 by threadably mounting the external thread, which is threaded on an outer peripheral surface of the ball plunger P, on an internal thread, which is threaded on an inner peripheral surface of the installation hole 304*c* of the movable jaw 4.

With the monkey wrench 301 thus configured, when the leaf spring portion 307 moves along the fitting groove 4*b*, the ball of the ball plunger P fits each positioning depressed portion 376 of the leaf spring portion 307. This allows positioning the leaf spring portion 307 to a predetermined position, and prevents a positional deviation where the position of the leaf spring portion 307 varies in each positioned position.

Here, in the case where the ball of the ball plunger P fits the positioning depressed portion 376 at an upper side (an upper side FIG. 7) among the plurality of the positioning depressed portion 376, the leaf spring portion 307 is positioned in a position (that is, a position where the protrusion 72 can fit each fitting depressed portion 8 in the row 9*c*) corresponding to the row 9*c*. In the case where the ball fits the positioning depressed portion 376 in the middle, the leaf spring portion 307 is positioned in a position (that is, a position where the protrusion 72 can fit each fitting depressed portion 8 in the row 9*b*) corresponding to the row 9*b*. In the case where the ball engages the positioning depressed portion 376 at a lower side (a lower side of FIG. 7), the leaf spring portion 307 is positioned in a position (that is, a position where the protrusion 72 can fit each fitting depressed portion 8 in the row 9*a*) corresponding to the row 9*a*.

In this case, regarding the leaf spring portion 307, in a state where the ball of the ball plunger P fits the positioning depressed portion 376 at the upper side or the positioning depressed portion 376 at the lower side, an end portion of the insertion hole 73 in a long diameter direction (a longitudinal direction, which is the top-bottom direction of FIG. 7) is brought into contact with the shaft portion of the fastening bolt B2. When the leaf spring portion 307 is positioned in a position corresponding to the row 9*c* or the row 9*a*, the leaf spring portion 307 is simply moved at a maximum in a movable range (that is, simply moved to a terminating end of the insertion hole 73). Accordingly, it is not necessary to stop the leaf spring portion 307 in the middle. This improves working efficiency of the positioning operation.

Thus, the monkey wrench 301 according to the third embodiment performs positioning and locking of the leaf spring portion 307 using fitting between the positioning depressed portion 376 and the ball of the ball plunger P. Accordingly, when the leaf spring portion 307 moves along the fitting groove 4*b*, for example, unlike the first the embodiment, it is not necessary to elastically deform the leaf spring portion 7 itself (that is, the peripheral area of the insertion hole 73). This smoothly moves the leaf spring portion 307 along the fitting groove 4*b*.

Figure 9:
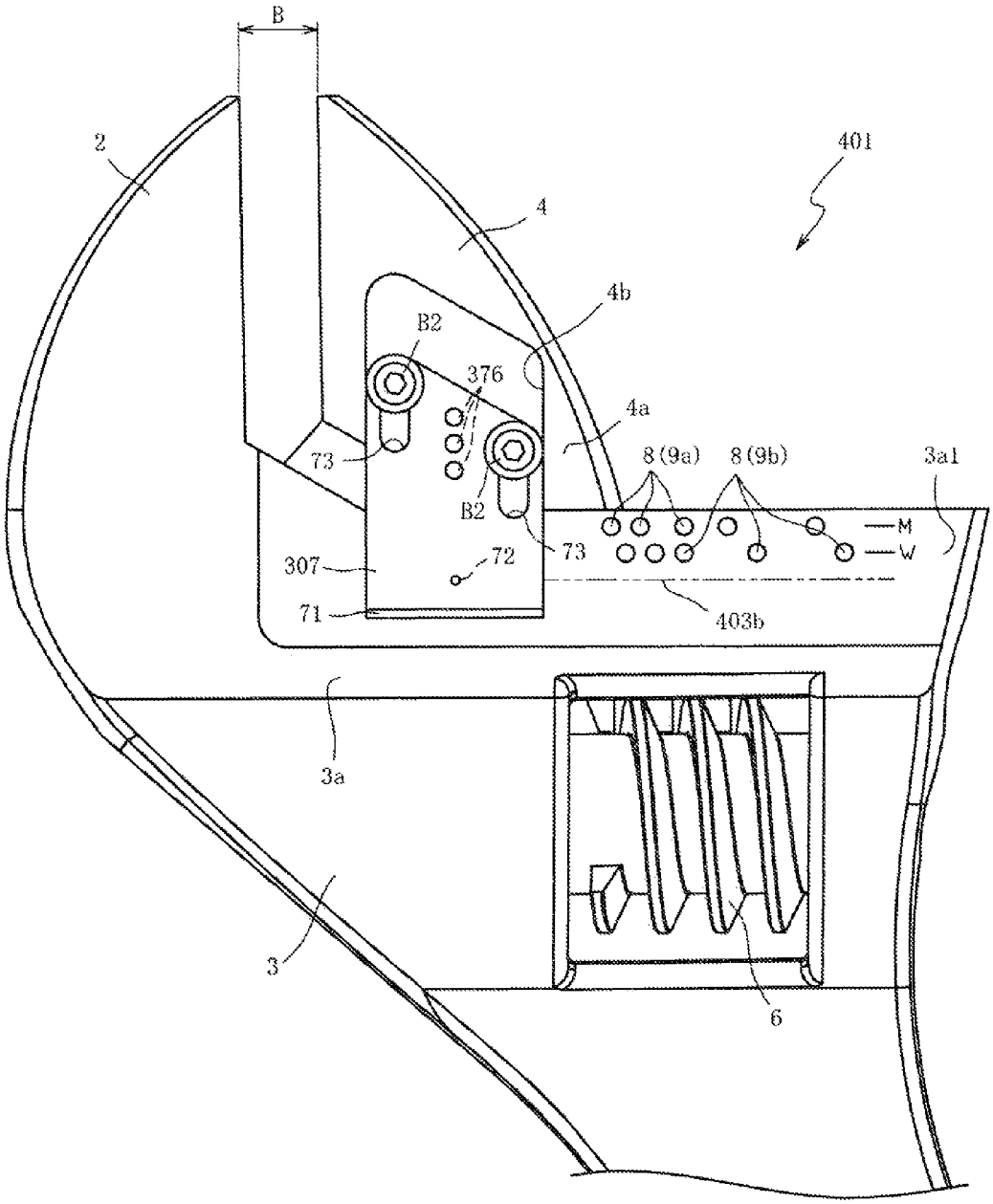
FIG. 9 is a partially enlarged front view of the monkey wrench according to a fourth embodiment.

Next, the fourth embodiment will be described with reference to FIG. 9. FIG. 9 is a partially enlarged front view of a monkey wrench 401 according to a fourth embodiment. Same reference numerals are given to the parts same to those of each embodiment above, and descriptions thereof are omitted.

The monkey wrench 401 of the fourth embodiment is different from the monkey wrench 301 of the third embodiment only in that the formation of the row 9*c* (see FIG. 7) is omitted. The fourth embodiment is otherwise similar to the third embodiment. Therefore, only different points will be described below.

As illustrated in FIG. 9, in the monkey wrench 401 of the fourth embodiment, only the row 9*a* and the row 9*b* are formed on the second side surface 3*a*1 of the wrench body 3.

That is, on the second side surface 3*a*1 of the wrench body 3 at a lower side (a lower side of FIG. 9) of the row 9*b* a region (hereinafter referred to as "a flat surface portion 403*b*") in a flat surface shape along the advancing/retreating direction (a lower side of FIG. 9) of the movable jaw 4 is formed.

Accordingly, in the case where the ball of the ball plunger P engages the positioning depressed portion 376 at an upper side (an upper side of FIG. 9) among the plurality of positioning depressed portions 376, the leaf spring portion 307 is positioned in a position (that is, a position where the protrusion 72 slides on the flat surface portion 403*b*) corresponding to the flat surface portion 403*b*. In FIG. 9, a trajectory of the protrusion 72 that slides on the flat surface portion 403*b* is schematically illustrated by a two-dot chain line.

Thus, with the monkey wrench 401 of the fourth embodiment, the second side surface 3*a*1 of the wrench body 3 includes the flat surface portion 403*b*. Additionally, the leaf spring portion 307 can be positioned in a position where the protrusion 72 is arranged in the flat surface portion 403*b*. This forms a configuration that advances and retreats the movable jaw 4 in a state where the protrusion 72 does not fit the fitting depressed portion 8.

That is, this allows the worker to adjust the position of the leaf spring portion 307 to select any of the following configurations. Fitting between the protrusion 72 and the fitting depressed portion 8 (in this embodiment, the row 9*a* and the row 9*b*) is used to ensure a configuration that provides the positioning function and the locking function of the width-across-flats size B. The protrusion 72 is not fitted to the fitting depressed portion 8 (that is, the protrusion 72 slides on the flat surface portion 403*b*) to ensure a configuration that does not provide the positioning function and the locking function of the width-across-flats size B.

Figure 10:
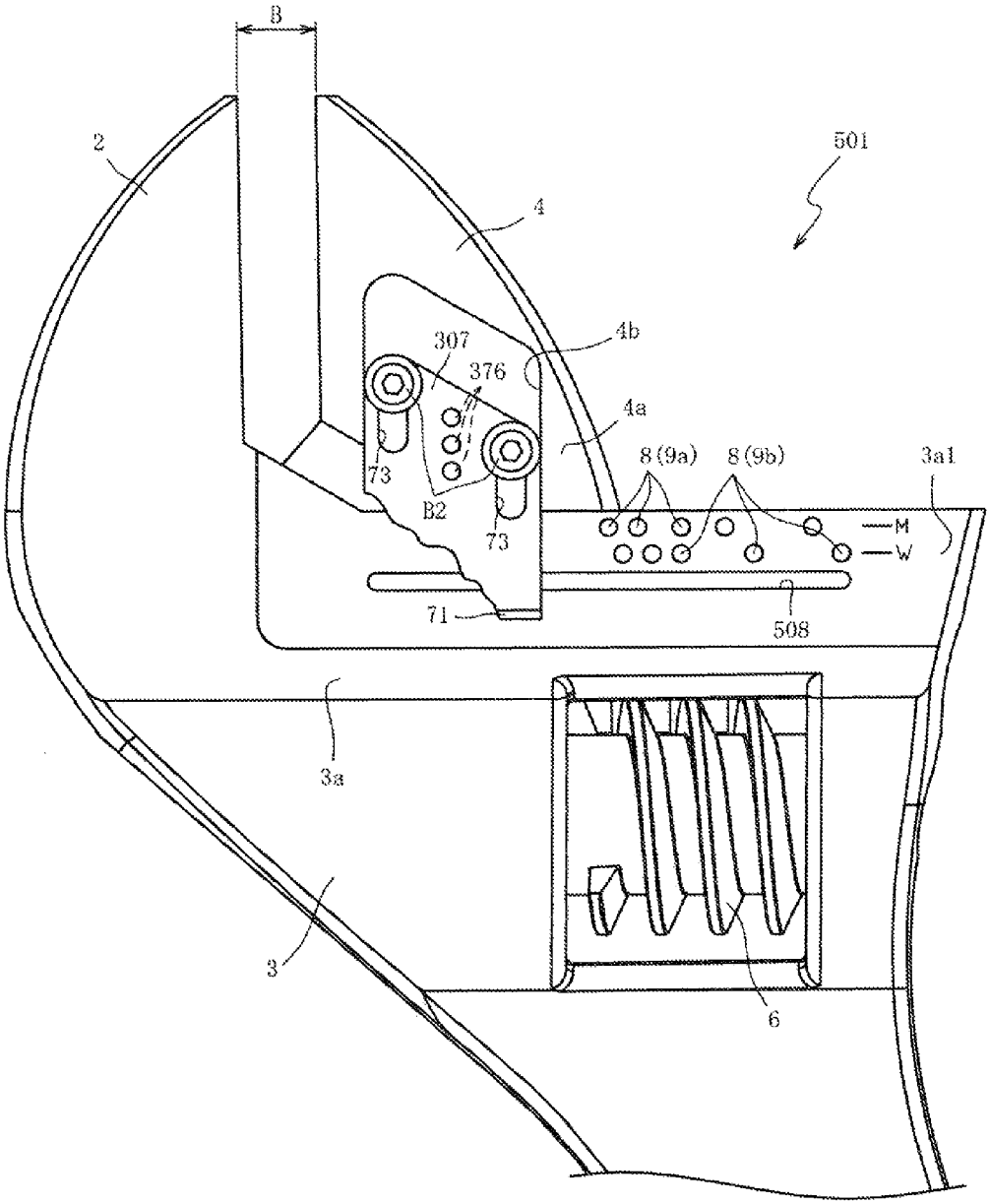
FIG. 10 is a partially enlarged front view of the monkey wrench according to a fifth embodiment.

Next, the fifth embodiment will be described with reference to FIG. 10. FIG. 10 is a partially enlarged front view of a monkey wrench 501 according to a fifth embodiment. FIG. 10 illustrates a state where a part of the leaf spring portion 307 is partially omitted. Same reference numerals are given to the parts same to those of each embodiment above, and descriptions thereof are omitted.

The monkey wrench 501 of the fifth embodiment is different from the monkey wrench 301 of the third embodiment only in that a continuous depressed groove 508 is formed instead of the row 9*c* (see FIG. 7). The fifth embodiment is otherwise similar to the third embodiment. Therefore, only different points will be described below.

As illustrated in FIG. 10, in the monkey wrench 501 of the fifth embodiment, the continuous depressed groove 508 is formed on the second side surface 3*a*1 of the wrench body 3. The continuous depressed groove 508 is a depressed groove that has the same cross-sectional shape as that of the fitting depressed portion 8 and extends in a continuous groove shape along the advancing/retreating direction (that is, a moving trajectory of the protrusion 72, which is a right-left direction of FIG. 10) of the movable jaw 4. The continuous depressed groove 508 is disposed at a lower side (a lower side of FIG. 10) of the row 9*b*.

Therefore, in the case where the ball of the ball plunger P engages the positioning depressed portion 376 at an upper side (an upper side of FIG. 10) among the plurality of positioning depressed portions 376, the leaf spring portion 307 is positioned in a position (that is, a position where the protrusion 72 can fit the continuous depressed groove 508) corresponding to the continuous depressed groove 508. When the movable jaw 4 advances and retreats, a state where the protrusion 72 fits the continuous depressed groove 508 is maintained. Here, one end (a left side of FIG. 10) of the continuous depressed groove 508 is set in a position where the protrusion 72 is fitted even in the case where the tool width-across-flats size B is zero.

Thus, with the monkey wrench 501 of the fifth embodiment, the second side surface 3*a*1 of the wrench body 3 includes the continuous depressed groove 508. Additionally, the leaf spring portion 307 can be positioned in a position where the protrusion 72 can fit the continuous depressed groove 508. This ensures a configuration that advances and retreats the movable jaw 4 in a state where fitting between the protrusion 72 and the continuous depressed groove 508 is maintained. That is, even in a state where the tool width-across-flats size B is adjusted to any width-across-flats size B, a state where the wrench body 3 and the movable jaw 4 are coupled via the leaf spring portion 307 is maintained. As a result, this reduces rattling of the movable jaw 4 with respect to the wrench body 3.

Figure 11:
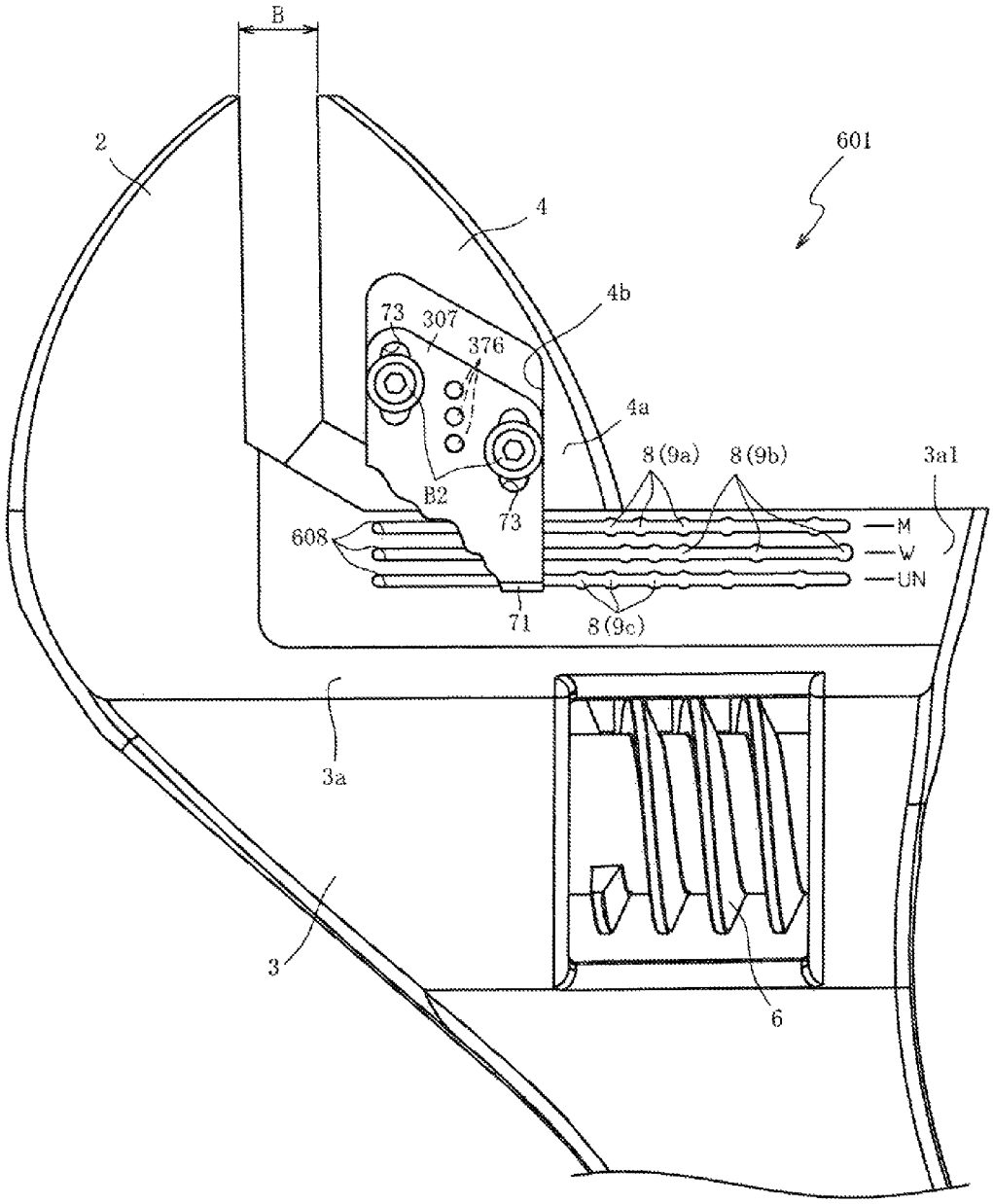
FIG. 11 is a partially enlarged front view of the monkey wrench of a sixth embodiment.

Next, the sixth embodiment will be described with reference to FIG. 11. FIG. 11 is a partially enlarged front view of a monkey wrench 601 of a sixth embodiment. FIG. 11 illustrates a state where a part of the leaf spring portion 307 is partially omitted. Same reference numerals are given to the parts same to those of each embodiment above, and descriptions thereof are omitted.

The monkey wrench 601 of the sixth embodiment is different from the monkey wrench 301 of the third embodiment only in that a guide groove 608 is newly disposed. The sixth embodiment is otherwise similar to the third embodiment. Therefore, only different points will be described below.

As illustrated in FIG. 11, the monkey wrench 601 of the sixth embodiment includes the guide groove 608 formed on the second side surface 3*a*1 of the wrench body 3. The guide groove 608 is a depressed groove that extends in a continuous groove shape along the advancing/retreating direction (that is, a moving trajectory of the protrusion 72, which is a right-left direction of FIG. 11) of the movable jaw 4. The guide groove 608 couples the plurality of the fitting depressed portions 8, and extends beyond the fitting depressed portion 8 at an end portion.

Additionally, the guide groove 608 has a smaller fitting margin (a depth in a vertical direction of the paper of FIG. 11) when the protrusion 72 is fitted than a fitting margin when the protrusion 72 fits the fitting depressed portion 8. That is, the guide groove 608 is depressed on the second side surface 3*a*1 of the wrench body 3 as a groove with a smaller groove width (a dimension in a top-bottom direction of FIG. 11) than that of the fitting depressed portion 8. The guide groove 608 has a shape to fit up to the middle of a distal end side of the protrusion 72. Therefore, in a state where the protrusion 72 fits the guide groove 608, the leaf spring portion 307 is elastically deformed (in a warped state in a direction separating from the second side surface 3*a*1). One end (a left side of FIG. 11) of the guide groove 608 is set in a position where the protrusion 72 is fitted even in the case where the tool width-across-flats size B is zero.

With the monkey wrench 601 of the sixth embodiment, the second side surface 3*a*1 of the wrench body 3 includes the guide groove 608. When the movable jaw 4 advances and retreats, this maintains a state where the protrusion 72 and the guide groove 608 fit together even in the position where the protrusion 72 does not fit the fitting depressed portion 8. That is, even in a state where the tool width-across-flats size B is necessary to be adjusted to a width-across-flats size B where the protrusion 72 and the fitting depressed portion 8 do not fit together, this maintains a state where the wrench body 3 and the movable jaw 4 are coupled together via the leaf spring portion 307. As a result, this reduces rattling of the movable jaw 4 with respect to the wrench body 3.

The guide groove 608 has the smaller fitting margin when the protrusion 72 is fitted than the fitting margin when the protrusion 72 fits the fitting depressed portion 8. Accordingly, when the movable jaw 4 advances and retreats, moving the protrusion 72 via the guide groove 608 allows the protrusion 72 to reliably fit each fitting depressed portion 8 using a guiding effect of the guide groove 608.

When the movable jaw 4 advances and retreats, the different fitting margins in the fitting depressed portion 8 and the guide groove 608 provide different operational feelings during fitting, thus providing different operational feelings transmitted to the worker. This allows the worker to recognize that the protrusion 72 passing through the guide groove 608 reaches the fitting depressed portion 8, thus facilitating the adjustment of the tool width-across-flats size B.

Figure 12:
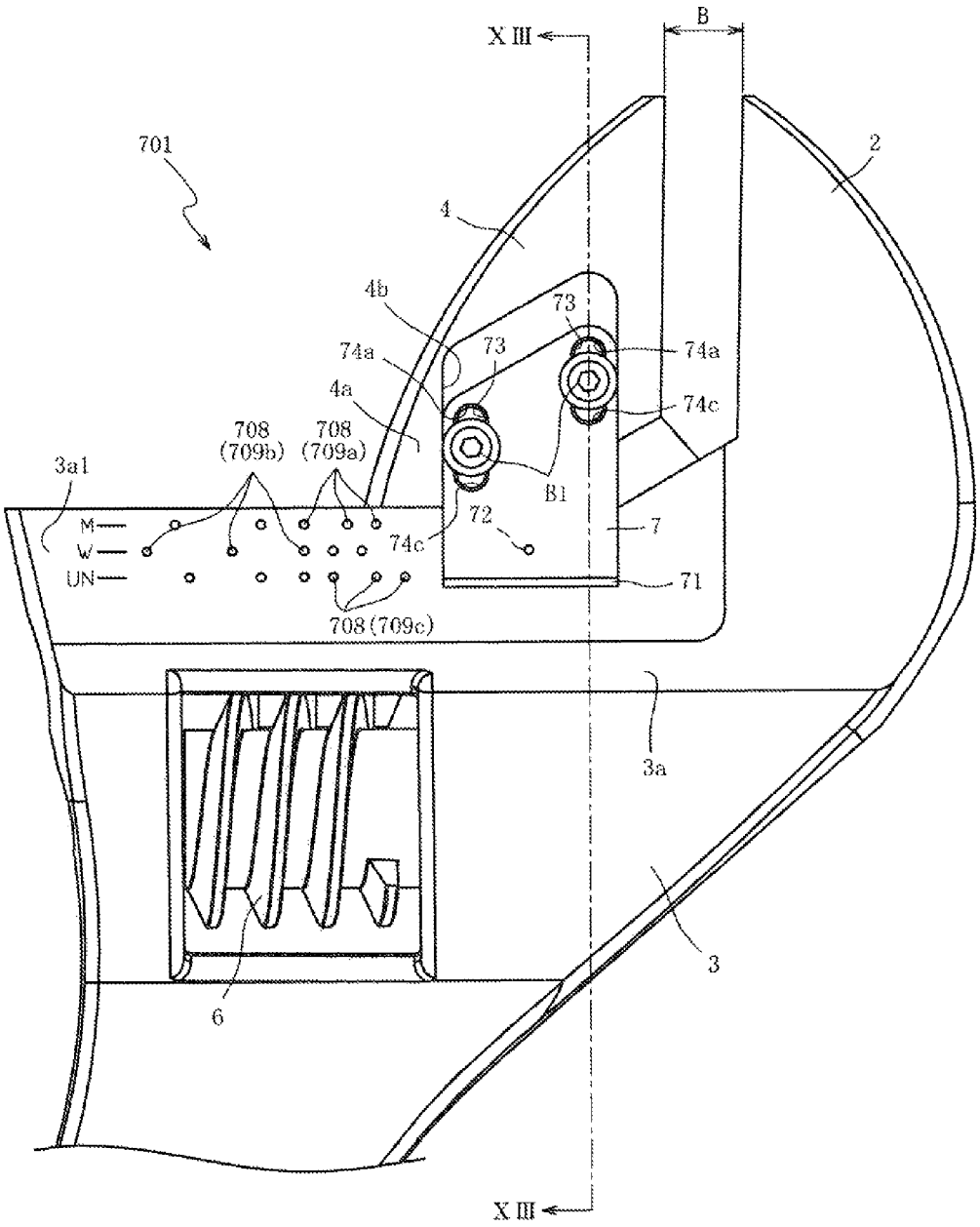
FIG. 12 is a partially enlarged back view of the monkey wrench of a seventh embodiment.
Figure 13:
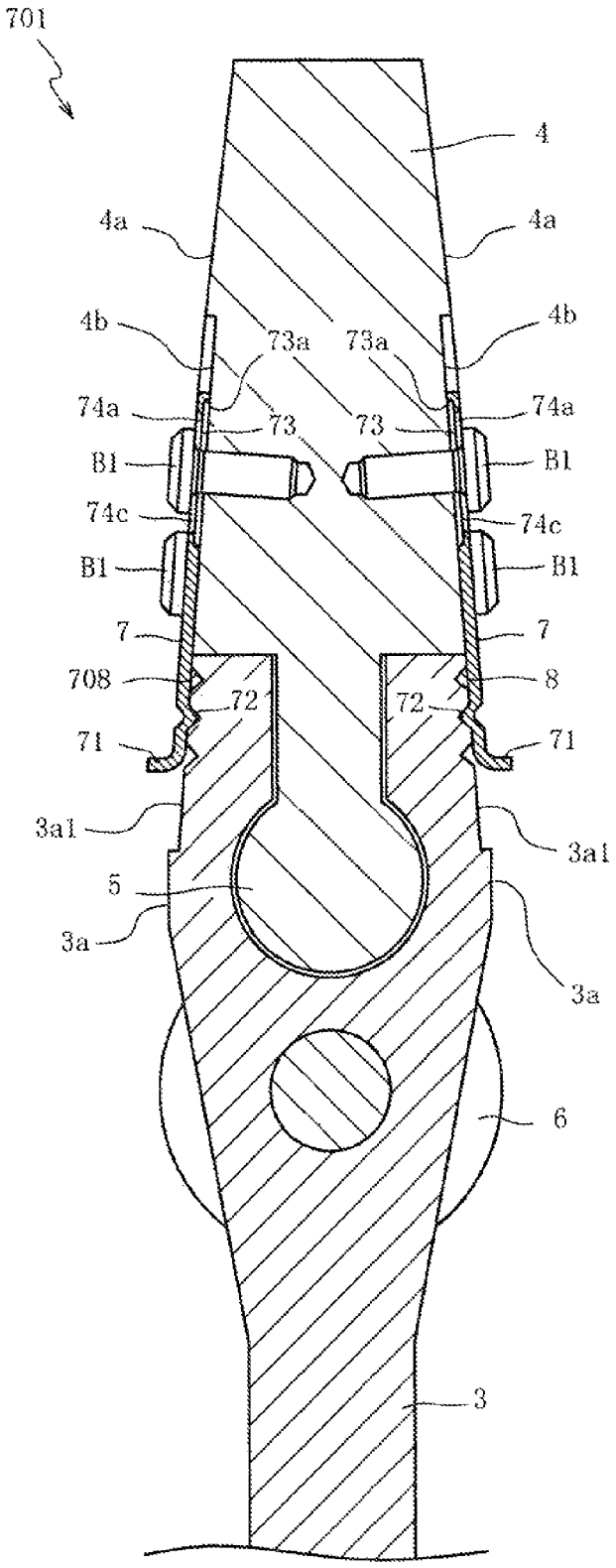
FIG. 13 is a partially enlarged cross-sectional view of the monkey wrench taken along the line XIII-XIII of FIG. 12.

Next, the seventh embodiment will be described with reference to FIGS. 12 and 13. FIG. 12 is a partially enlarged cross-sectional view of a monkey wrench 701 of a seventh embodiment. FIG. 13 is a partially enlarged cross-sectional view of the monkey wrench 701 taken along the line XIII-XIII of FIG. 12. Same reference numerals are given to the parts same to those of each embodiment above, and descriptions thereof are omitted.

The monkey wrench 701 of the seventh embodiment is different from the monkey wrench 1 of the first embodiment only in that a back side (a left side of FIG. 13) has the same configuration as that of a front side (a right side of FIG. 13) and that a fitting margin of the fitting depressed portion 708 at the back side is smaller than a fitting margin of the fitting depressed portion 8 at the front side. The seventh embodiment is otherwise similar to the first embodiment. Therefore, only different points will be described below.

As illustrated in FIG. 12 and FIG. 13, in the monkey wrench 701 of the seventh embodiment, the front side (the right side of FIG. 13) has the same configuration as that in the monkey wrench 1 (see FIG. 2A) of the first embodiment. The back side (see FIG. 12) has the same configuration as that at the front side other than the fitting margin of the fitting depressed portion 708. That is, at the back side, the second side surface 3*a*1 is depressed on the side surface 3*a* of the wrench body 3. Additionally, the fitting groove 4*b* is depressed on the side surface 4*a* of the movable jaw 4. The leaf spring portion 7 is mounted on the inner side of the fitting groove 4*b*. The leaf spring portions 7 at the front side and the back side are formed in mutually symmetrical shapes. Therefore, for convenience, like reference numerals designate corresponding or identical elements throughout both in the following description.

In the second side surface 3*a*1 of the wrench body 3 at the back side, as illustrated in FIG. 12, a plurality of fitting depressed portions 708 are disposed in a straight line along the advancing/retreating direction (a right-left direction of FIG. 12) of the movable jaw 4 to form rows 709*a* to 709*c*. These rows 709*a* to 709*c* (the plurality of fitting depressed portions 708) are arranged in the same positions (phases) as those of the rows 9*a* to 9*c* (the plurality of fitting depressed portions 8) at the front side (the right side of FIG. 13).

With the monkey wrench 701, on both side surfaces at the front side and the back side, in the case where the rows (such as, the front side: the row 9*a* (compliant to the metric thread standard), the back side: the row 709*a* (compliant to the metric thread standard)) compliant to the same screw standard are selected, a positional relationship at the front side between the protrusion 72 and each fitting depressed portion 8 coincides with a positional relationship at the back side between the protrusion 72 and each fitting depressed portion 708.

In this case, when the movable jaw 4 advances and retreats, in the case where the protrusion 72 fits the fitting depressed portion 8 at the front side, the protrusion 72 fits the fitting depressed portion 708 at the back side. In the case where the protrusion 72 does not fit the fitting depressed portion 8 at the front side, the protrusion 72 does not fit the fitting depressed portion 708 at the back side.

Accordingly, when the tool width-across-flats size B is adjusted, on both side surfaces at the front side and the back side (the second side surface 3*a*1), this forms a state where the protrusions 72 fit the fitting depressed portions 8 and 708. This reliably provides the locking function of the tool width-across-flats size B. When the movable jaw 4 advances and retreats, on both the side surfaces at the front side and the back side, this simultaneously performs fitting of the protrusions 72 into the fitting depressed portions 8 and 708 and releasing. This ensures that the worker recognizes the state (the fitting state or the non-fitting state), thus improving working efficiency of the positioning operation.

On the other hand, on both the side surfaces at the front side and the back side, in the case where the rows (for example, the front side: the row 9*a* (compliant to the metric thread standard), the back side: the row 709*b* (compliant to the Whitworth screw thread standard)) compliant to different screw standards are selected, a positional relationship at the front side between the protrusion 72 and each fitting depressed portion 8 is different from a positional relationship at the back side between the protrusion 72 and each fitting depressed portion 708.

In this case, when the movable jaw 4 advances and retreats, in the case where the protrusion 72 fits the fitting depressed portion 8 at the front side, the protrusion 72 does not fit the fitting depressed portion 708 at the back side. In contrast, in the case where the protrusion 72 fits the fitting depressed portion 708 at the back side, the protrusion 72 does not fit the fitting depressed portion 8 at the front side. However, the protrusion 72 becomes a fitting state on both the side surfaces depending on the tool width-across-flats size B to be set.

With the monkey wrench 701, the fitting margin at the front side between the protrusion 72 and each fitting depressed portion 8 is different from the fitting margin at the back side between the protrusion 72 and each fitting depressed portion 708. When the tool width-across-flats size B is adjusted, an operational feeling generated by fitting of the protrusion 72 into the fitting depressed portion 8 at the front side is different from an operational feeling generated by fitting of the protrusion 72 into the fitting depressed portion 708 at the back side.

This provides different operational feelings transmitted to the worker. Accordingly, the worker can recognize: a position for positioning the tool width-across-flats size B adjusted using the fitting between one row (such as the row 9*a* compliant to the metric thread standard) at the front side and the protrusion 72, and a position for positioning the tool width-across-flats size B adjusted using the fitting between one row (such as the row 709*b* compliant to the Whitworth screw thread standard) at the back side and the protrusion 72, by a difference in operational feeling.

Here, in the monkey wrench 701, in the case where the rows at the front side and the back side are compliant to the same screw standard, pitches of the fitting depressed portions 8 and 708 are the same. For example, in the case where the row 9*a* at the front side and the row 709*a* at the back side are compliant to the metric thread standard, the fitting depressed portions 8 at the front side and the fitting depressed portions 708 at the back side are each arranged in pitches to adjust the tool width-across-flats size B to 16 mm, 18 mm, 21 mm, 24 mm, and 30 mm.

Alternatively, the fitting depressed portions 8 and 708 of the rows compliant to the same screw standard may have different pitches. For example, in the rows 9*a* and 709*a* exemplarily described above, the fitting depressed portions 8 of the row 9*a* are arranged in pitches to adjust the tool width-across-flats size B to 16 mm, 18 mm, 21 mm, 24 mm, and 30 mm while the fitting depressed portions 708 of the row 709*a* are arranged in pitches to adjust the tool width-across-flats size B to 17 mm, 19 mm, 23 mm, and 27 mm, as an exemplary configuration.

This provides different fitting states between the protrusion 72 and the fitting depressed portion 8 and between the protrusion 72 and the fitting depressed portion 708 on both the side surfaces (the second side surfaces 3*a*1) at the front side and the back side when the movable jaw 4 advances and retreats to adjust the tool width-across-flats size B. That is, a limited area of the second side surface 3*a*1 of the wrench body 3 is effectively used to ensure the number of selectable fitting positions (that is, the kind of the tool width-across-flats size B to provide the positioning function and the locking function).

Figure 14B:
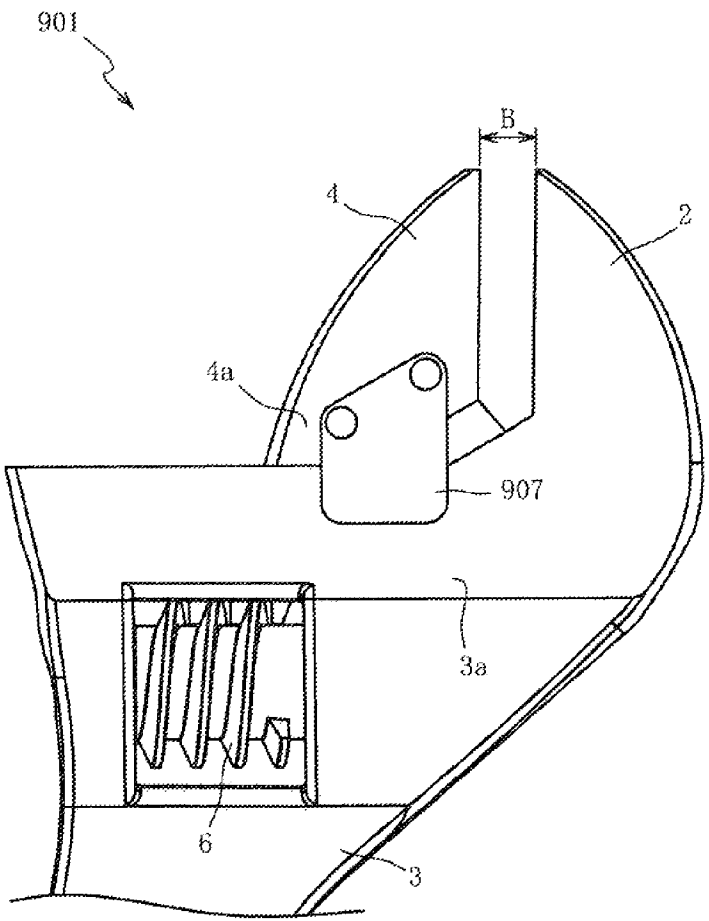
FIG. 14B is a partially enlarged back view of the monkey wrench according to a ninth embodiment.
Figure 14A:
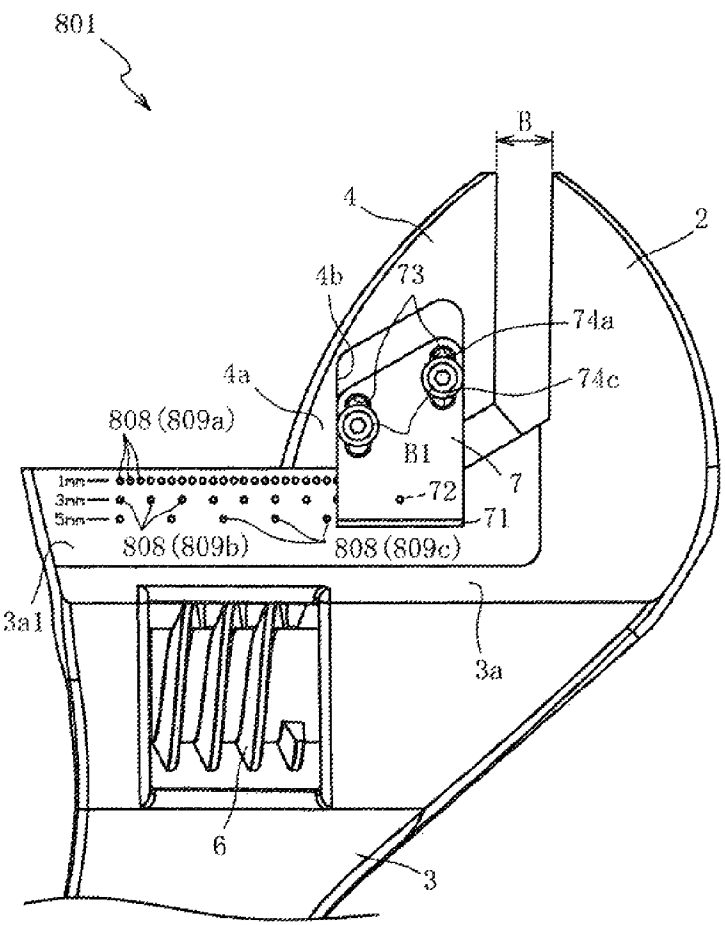
FIG. 14A is a partially enlarged back view of the monkey wrench according to an eighth embodiment.

Next, the eighth embodiment will be described with reference to FIG. 14A. FIG. 14A is a partially enlarged back view of a monkey wrench 801 according to an eighth embodiment. Same reference numerals are given to the parts same to those of each embodiment above, and descriptions thereof are omitted.

The monkey wrench 801 of the eighth embodiment is different from the monkey wrench 701 of the seventh embodiment only in that the pitch of the fitting depressed portion 808 at the back side (but the same in that the fitting margin of the fitting depressed portion 808 at the back side is smaller than the fitting margin of the fitting depressed portion 8 at the front side). The eighth embodiment is otherwise similar to the seventh embodiment. Therefore, only different points will be described below.

As illustrated in FIG. 14A, in the monkey wrench 801 of the eighth embodiment, on the second side surface 3*a*1 of the wrench body 3 at the back side, a plurality of fitting depressed portions 808 are arranged in equally spaced pitches in a straight line along the advancing/retreating direction (a right-left direction of FIG. 14A) of the movable jaw 4. That is, in this embodiment, a pitch of the fitting depressed portion 808 constituting the row 809*a* is set to 1 mm, a pitch of the fitting depressed portion 808 constituting the row 809*b* is set to 3 mm, and a pitch of the fitting depressed portion 808 constituting the row 809*c* is set to 5 mm.

With the monkey wrench 801, the plurality of fitting depressed portions 808 are arranged in equally spaced pitches along the advancing/retreating direction of the movable jaw 4. This improves versatility and convenience of the monkey wrench 801. For example, even in the case where the width-across-flats size B of the object to be sandwiched is compliant to a standard to which the respective pitches of the fitting depressed portions 8 of the rows 9*a* to 9*c* at the front side are not adapted, this enhances the possibility that one of the respective fitting depressed portions 808 at the back side is adapted, thus enhancing the versatility of the fitting depressed portions 8. Additionally, the plurality of fitting depressed portions 808 are equally spaced. This allows utilizing the tool width-across-flats size B as a scale, thus improving convenience of the fitting depressed portions 808.

Additionally, with the monkey wrench 801, similarly to the case of the monkey wrench 701 of the seventh embodiment, when the tool width-across-flats size B is adjusted, an operational feeling generated by fitting of the protrusion 72 into the fitting depressed portion 8 at the front side is different from an operational feeling generated by fitting of the protrusion 72 into the fitting depressed portion 808 at the back side. This provides different operational feelings transmitted to the worker.

Accordingly, the worker can recognize: a position for positioning the tool width-across-flats size B adjusted using the fitting between one row (such as the row 9*a* compliant to the metric thread standard) at the front side and the protrusion 72, and a position for positioning the tool width-across-flats size B adjusted using the fitting between one row (that is, the fitting depressed portion 808 arranged in equally spaced pitches) at the back side and the protrusion 72, by a difference in operational feeling.

Next, the ninth embodiment will be described with reference to FIG. 14B. FIG. 14B is a partially enlarged back view of a monkey wrench 901 according to a ninth embodiment. Same reference numerals are given to the parts same to those of each embodiment above, and descriptions thereof are omitted.

The monkey wrench 901 of the ninth embodiment is different from the monkey wrench 1 of the first embodiment only in that the leaf spring portion 907 is fixedly secured to the back side. The ninth embodiment is otherwise similar to the first embodiment. Therefore, only different points will be described below.

As illustrated in FIG. 14B, the monkey wrench 901 of the ninth embodiment includes a leaf spring portion 907. The leaf spring portion 907 is a member formed as a leaf spring from a metallic plate-shaped body. In the leaf spring portion 907, a base end side (an upper side of FIG. 14B) is fixedly secured to the side surface 4*a* of the movable jaw 4 by a press-fit pin while a distal end side (a lower side of FIG. 14B) is disposed facing the side surface 3*a* of the wrench body 3. The distal end side is elastically deformable (flexurally deformable) in approaching and separating directions with respect to the side surface 3*a* of the wrench body 3.

With the monkey wrench 901, at the front side, the leaf spring portion 7 and the plurality of rows 9*a* to 9*c* are arranged (see FIG. 2A). This simply and reliably provides the positioning function when the tool width-across-flats size B is adjusted and the locking function of the adjusted width-across-flats size B with respect to the width-across-flats sizes B of different standards.

In this case, the monkey wrench 901 also includes the leaf spring portion 907 at the back side. The leaf spring portions 7 and 907 on both the side surfaces at the front side and the back side allows sandwiching the wrench body 3 from both sides, thus effectively providing elastic forces to the leaf spring portions 7 and 907 in a direction where rattling is corrected.

Further, the leaf spring portion 907 is fixedly secured to the movable jaw 4, and not necessary to move. At the back side, it is not necessary that the fitting depressed portion 8 is formed. This reduces the process cost, thus reducing total product cost of the monkey wrench 901.

Figure 15B:
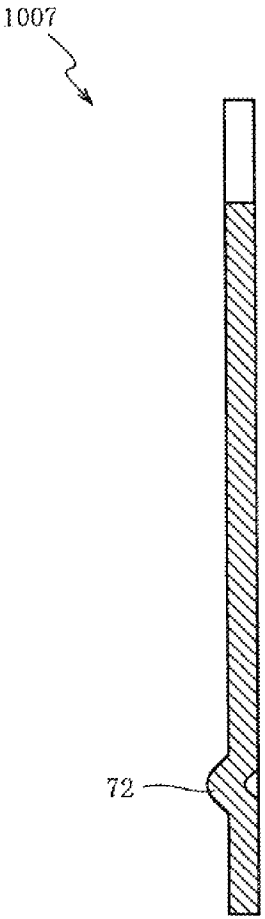
FIG. 15B is a cross-sectional view of the leaf spring portion taken along the line XVb-XVb of FIG. 15A.
Figure 15A:
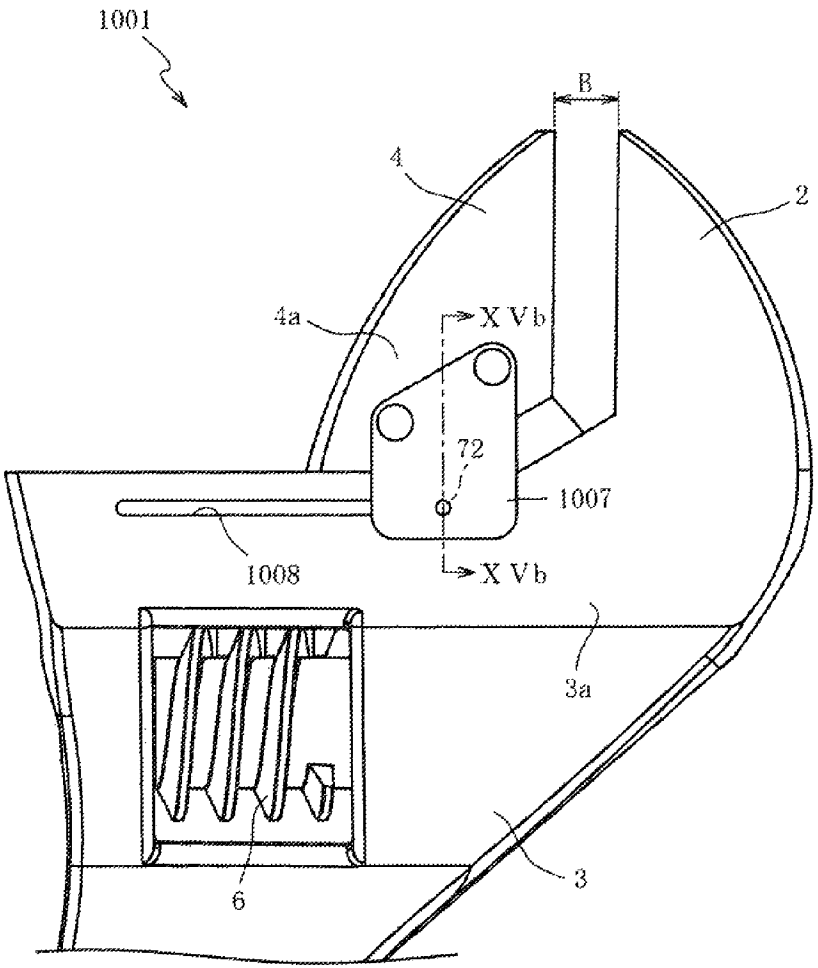
FIG. 15A is a partially enlarged back view of the monkey wrench 1001 according to a tenth embodiment.

Next, the tenth embodiment will be described with reference to FIG. 15. FIG. 15A is a partially enlarged back view of a monkey wrench 1001 according to a tenth embodiment. FIG. 15B is a cross-sectional view of a leaf spring portion 1007. FIG. 15B corresponds to a cross-sectional view taken along the line XVb-XVb of FIG. 15A. Same reference numerals are given to the parts same to those of each embodiment above, and descriptions thereof are omitted.

The monkey wrench 1001 of the tenth embodiment is different from the monkey wrench 901 of the ninth embodiment only in that a continuous depressed groove 1008 is newly disposed on the side surface 3*a* of the wrench body 3 and that a protrusion 72 is newly disposed on the leaf spring portion 1007. The tenth embodiment is otherwise similar to the ninth embodiment. Therefore, only different points will be described below.

As illustrated in FIGS. 15A and 15B, in the monkey wrench 1001 of the tenth embodiment, the continuous depressed groove 1008 is formed on the side surface 3*a* of the wrench body 3. On the other hand, the protrusion 72 that fits the continuous depressed groove 1008 is formed in the leaf spring portion 1007. The continuous depressed groove 1008 has the same configuration as that of the continuous depressed groove 508 of the fifth embodiment. Therefore, this will not be further elaborated here.

Accordingly, with the monkey wrench 1001, when the movable jaw 4 advances and retreats, at the back side (a near-side in the paper of FIG. 15A), a state where the protrusion 72 fits the continuous depressed groove 1008 is maintained. Even in the case where the tool width-across-flats size B is zero, one end (a right side of FIG. 15A) of the continuous depressed groove 1008 is set in a position to allow fitting of the protrusion 72.

Thus, with the monkey wrench 1001 of the tenth embodiment, the leaf spring portion 7 and the plurality of rows 9*a* to 9*c* are disposed at the front side (see FIG. 2A). This simply and reliably provides the positioning function when the tool width-across-flats size B is adjusted and the locking function of the adjusted width-across-flats size B with respect to the width-across-flats sizes B of different standards.

In this case, at the back side, the leaf spring portion 1007 is fixedly secured and the continuous depressed groove 1008 is depressed to fit the protrusion 72 of the leaf spring portion 1007. Regardless of the state (a fitting state and a non-fitting state) between the protrusion 72 and the fitting depressed portion 8 at the front side (see FIG. 2A), at the back side, in a state where the fitting of the protrusion 72 into the continuous depressed groove 1008 is maintained, the configuration allows the movable jaw 4 to advance and retreat.

That is, in a state where the tool width-across-flats size B is adjusted to any width-across-flats size B, the wrench body 3 and the movable jaw 4 at least at the back side maintain a state coupled via the leaf spring portion 1007. As a result, this reduces rattling of the movable jaw 4 with respect to the wrench body 3.

Figure 16B:
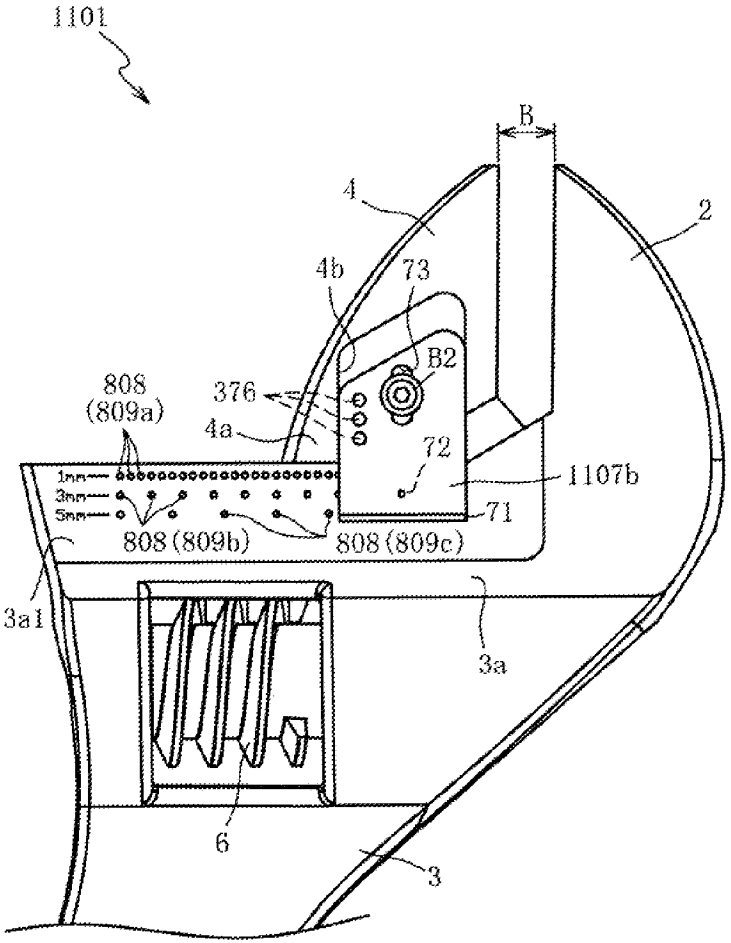
FIG. 16A is a partially enlarged front view of the monkey wrench according to an eleventh embodiment.
Figure 16A:
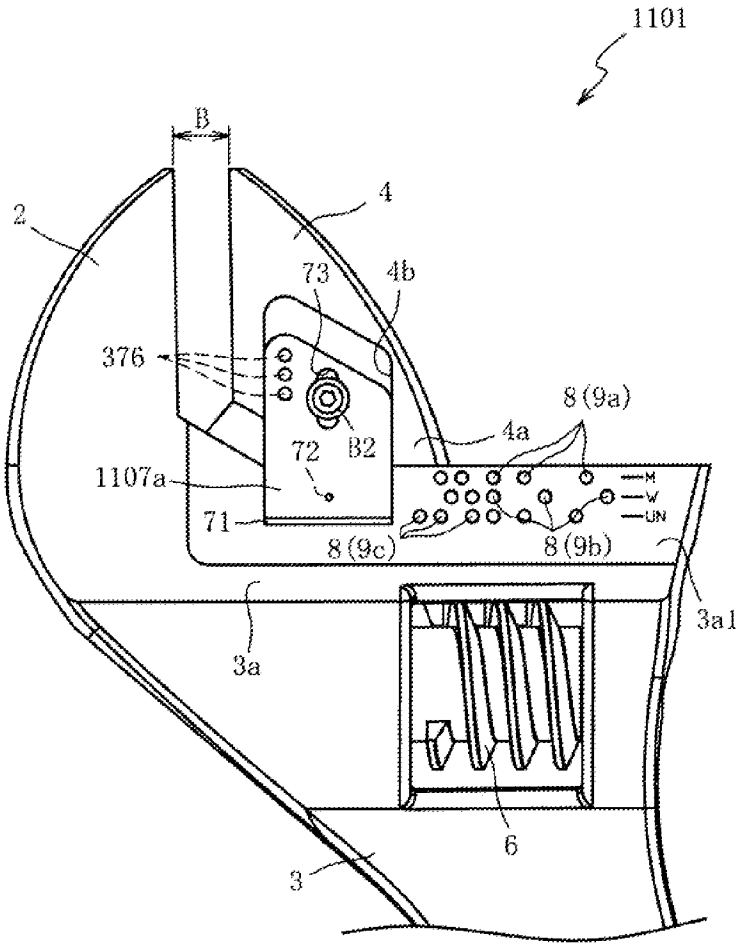

Next, the eleventh embodiment will be described with reference to FIG. 16. FIG. 16A is a partially enlarged front view of a monkey wrench 1101 according to an eleventh embodiment. FIG. 16B is a partially enlarged back view of the monkey wrench 1101. Same reference numerals are given to the parts same to those of each embodiment above, and descriptions thereof are omitted.

The monkey wrench 1101 of the eleventh embodiment is different from the monkey wrench 801 of the eighth embodiment only in configurations of the leaf spring portions 1107*a* and 1107*b* and positioning structures of the leaf spring portions 1107*a* and 1107*b*. The eleventh embodiment is otherwise similar to the eighth embodiment. Therefore, only different points will be described below.

As illustrated in FIGS. 16A and 16B, the leaf spring portions 1107*a* and 1107*b* of the monkey wrench 1101 of the eleventh embodiment are formed to move along the fitting groove 4*b* similarly to the leaf spring portion 307 of the third embodiment. Additionally, the fastening bolt B2 is inserted into the insertion hole 73, and fitting the ball of the ball plunger P (see FIG. 8B) into the positioning depressed portion 376 allows positioning and locking.

Specifically, the insertion hole 73 is disposed at the center in a width direction (a right-left direction of FIG. 16A) in both the leaf spring portions 1107*a* and 1107*b* at the front side and the back side. On the other hand, in the leaf spring portion 1107*a* at the front side, the positioning depressed portion 376 is disposed in a position (at a left side of FIG. 16A) close to the fixed jaw 2 with respect to the insertion hole 73. In the leaf spring portion 1107*b* at the back side, the positioning depressed portion 376 is disposed in a position (a left side of FIG. 16B) distant from the fixed jaw 2 with respect to the insertion hole 73.

That is, the pair of installation holes 304*c* (see FIG. 8B) for disposing the ball plunger P at the front side and the ball plunger P at the back side are disposed in the shifted positions along a movement direction of the movable jaw 4 without mutual interference. As a result, this provides positioning and locking of the leaf spring portions 1107*a* and 1107*b* on both side surfaces at the front side and the back side using the balls of the ball plungers P, thus smoothly moving the leaf spring portions 1107*a* and 1107*b* on both the side surfaces along the fitting groove 4*b*.

Figure 17:
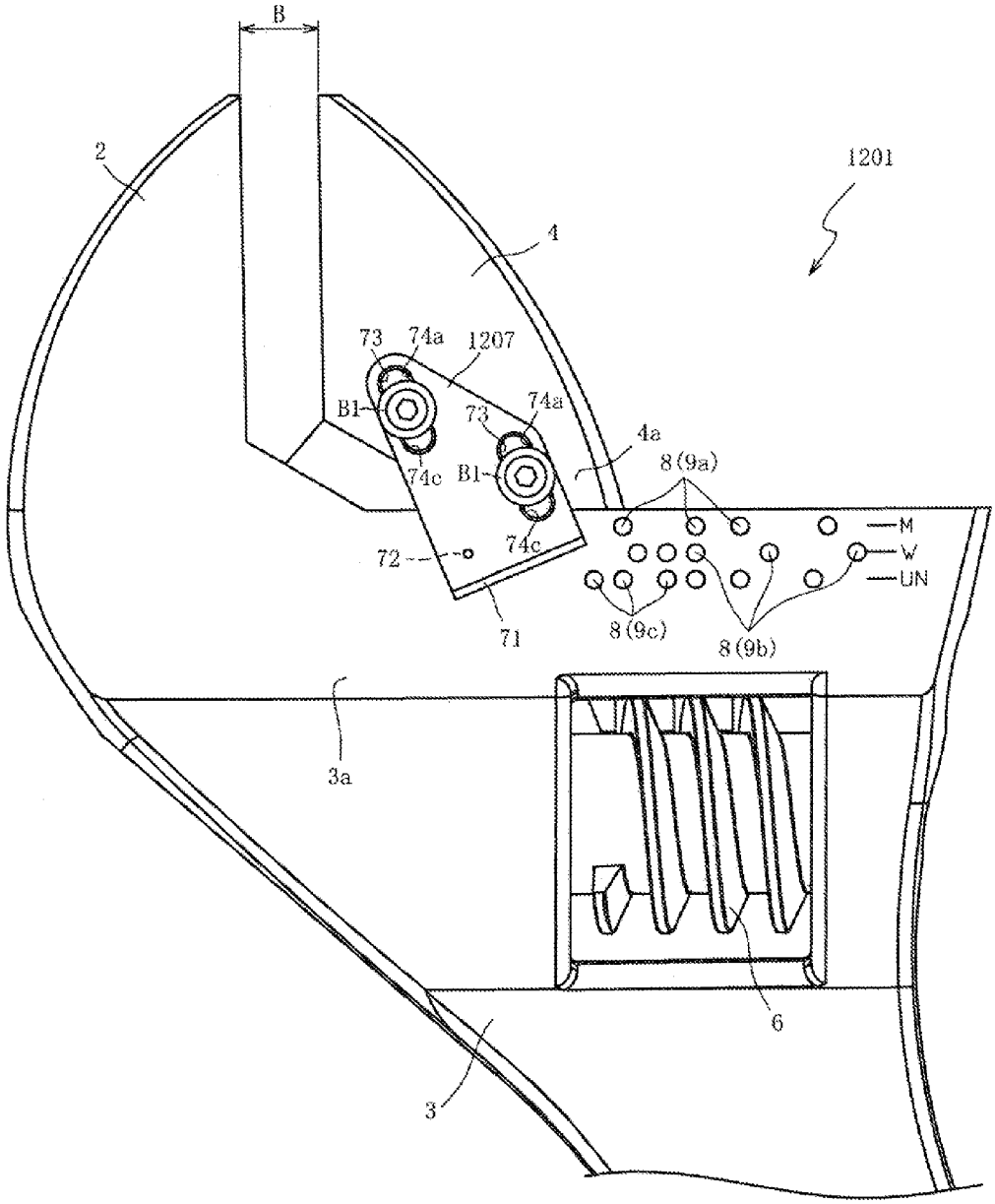
FIG. 17 is a partially enlarged front view of the monkey wrench according to a twelfth embodiment.

Next, the twelfth embodiment will be described with reference to FIG. 17. FIG. 17 is a partially enlarged front view of a monkey wrench 1201 according to a twelfth embodiment. Same reference numerals are given to the parts same to those of each embodiment above, and descriptions thereof are omitted.

The monkey wrench 1201 of the twelfth embodiment is different from the monkey wrench 1 of the first the embodiment only in movement direction of the leaf spring portion 1207. The twelfth embodiment is otherwise similar to the first the embodiment. Therefore, only different points will be described below.

As illustrated in FIG. 17, the leaf spring portion 1207 of the twelfth embodiment includes, similarly to the leaf spring portion 7 of the first the embodiment, the chamfered portions 74*a* to 74*c* in the peripheral area of the insertion hole 73 (however, in FIG. 17, the reference numeral "74*b*" is omitted). The chamfered portions 74*a* to 74*c* engage the conical portion (the conical portion continuous with the seating face) formed in the shaft portion of the fastening bolt B1 to provide positioning and locking.

In this case, the leaf spring portion 1207 is fastened and secured with the fastening bolt B1 in a state where the long diameter direction (the longitudinal direction) of the insertion hole 73 in the oval-like shape from a front view is inclined to the direction (a top-bottom direction of FIG. 17) perpendicular to the movement direction of the movable jaw 4. Accordingly, in this embodiment, the movement direction of the leaf spring portion 1207 is a direction inclined to the direction (the top-bottom direction of FIG. 17) perpendicular to the movement direction of the movable jaw 4.

The protrusion 72 is arranged in a position shifted to one side from the width direction center of the leaf spring portion 1207. When engagement between the chamfered portions 74*a* to 74*c* and the conical portion of the fastening bolt B1 positions the leaf spring portion 1207 in a position corresponding to any of the rows 9*a* to 9*c*, the protrusion 72 is positioned in a position to fit each fitting depressed portion 8 in any of the rows 9*a* to 9*c*.

Here, while in the twelfth embodiment the second side surface 3*a*1 and the fitting groove 4*b* are omitted in the description, the second side surface 3*a*1 and the fitting groove 4*b* may be disposed similarly to the case of the first embodiment. In this case, the respective fitting depressed portions 8 are depressed on the second side surface 3*a*1. Additionally, the fitting groove 4*b* extends along the movement direction (that is, the direction inclined to the direction perpendicular to the movement direction of the movable jaw 4) of the leaf spring portion 1207.

Next, the thirteenth embodiment will be described with reference to FIG. 18. FIG. 18A and FIG. 18B are a partially enlarged front view and a partially enlarged back view of a monkey wrench 1301 according to a thirteenth embodiment. FIG. 18A and FIG. 18B illustrate a state where a nut as an exemplary object to be sandwiched is sandwiched between the fixed jaw 2 and the movable jaw 4.

While in the first embodiment the leaf spring portion 7 is disposed only at the front side of the movable jaw 4 and the leaf spring portion 7 is movably attached to the side surface 4*a* of the movable jaw 4, the leaf spring portion 1307 of the thirteenth embodiment is disposed at each of the front side and the back side of the movable jaw 4 and the leaf spring portions 1307 at the front side and the back side are firmly fixed (fixedly secured) to the side surface 4*a* of the movable jaw 4. Same reference numerals are given to the parts same to those of each embodiment above, and descriptions thereof are omitted.

Figure 18B:
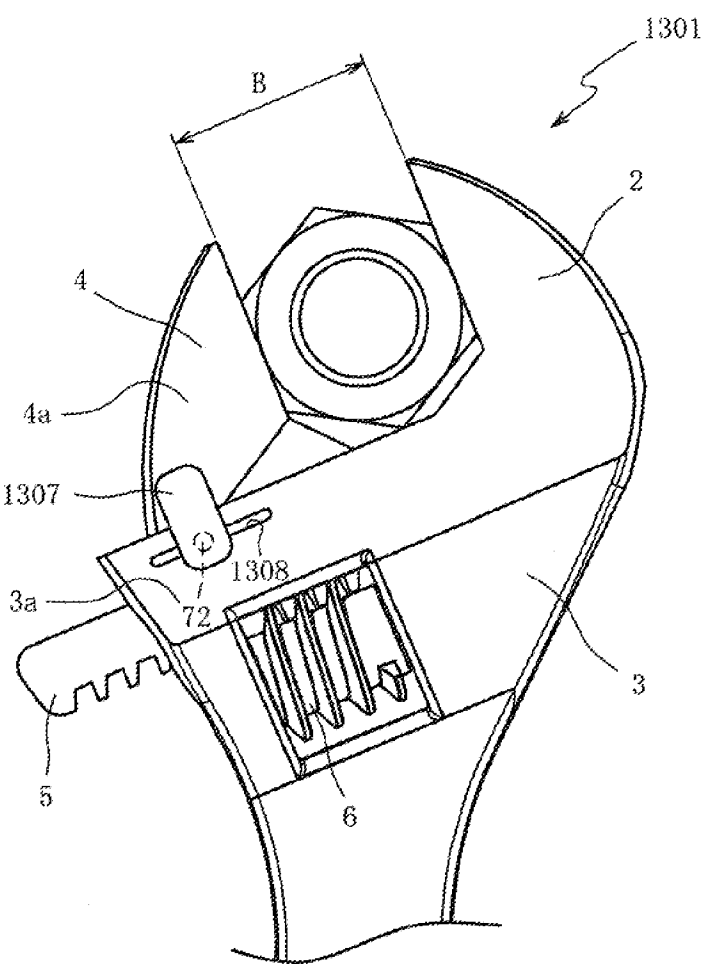
FIG. 18A and FIG. 18B are a partially enlarged front view and a partially enlarged back view of the monkey wrench according to a thirteenth embodiment.
Figure 18A:
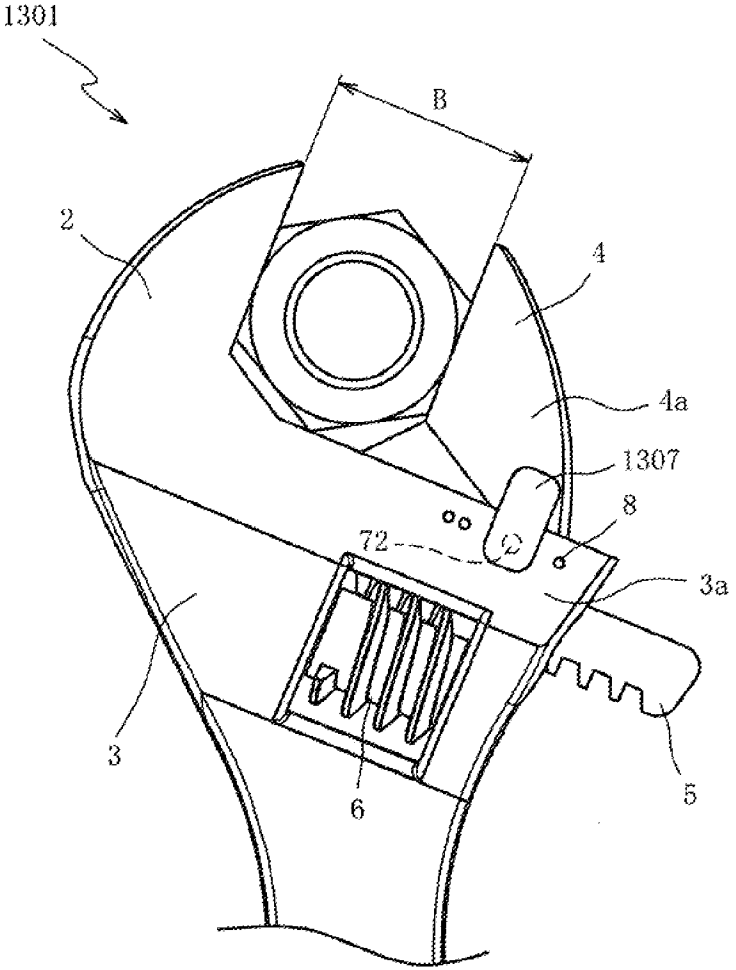

As illustrated in FIG. 18A and FIG. 18B, the leaf spring portion 1307 of the thirteenth embodiment is a member formed as a leaf spring that is formed from a plate-shaped body made of elastic material. In the leaf spring portion 1307, a base end side is firmly fixed to the side surface 4*a* of the movable jaw 4, and a distal end side is arranged facing the side surface 3*a* of the wrench body 3. Thus, the leaf spring portion 1307 has the elastically deformable (flexurally deformable) distal end side in the approaching and separating directions with respect to the side surface 3*a* of the wrench body 3.

In this embodiment, the leaf spring portion 1307 is formed by press forming of a sheet-shaped material, and firmly fixed to the side surface 4*a* of the movable jaw 4 by spot welding. Thus, the leaf spring portion 1307 is strongly fastened. However, like the leaf spring portions 907 and 1007 of the ninth and tenth embodiments, the leaf spring portion 1307 may be firmly fixed (fixedly secured) by a press fitting pin. Additionally, the leaf spring portion 7 may be removably fastened and secured to the movable jaw 4 by a bolt. In this case, the leaf spring portion 1307 can be replaced in the case of damage or abrasion. Similarly, the leaf spring portions 907 and 1007 of the ninth and tenth embodiments may be removably fastened and secured by bolts.

The leaf spring portion 1307 includes the protrusion 72 that protrudes toward the side surface 3*a* of the wrench body 3 from the distal end side. The protrusion 72 can fit each of the plurality of fitting depressed portions 8 depressed on the side surface 3*a* of the wrench body 3. The respective fitting depressed portions 8 are disposed along a moving trajectory traced by the distal end of the protrusion 72 when the movable jaw 4 advances and retreats. That is, the plurality (in the thirteenth embodiment, four) of fitting depressed portions 8 of the thirteenth embodiment form only one row. In the thirteenth embodiment, the protrusion 72 fits each fitting depressed portion 8 to form four types of width-across-flats sizes B. These four types of width across flats sizes B are set to sizes of nuts (the objects to be sandwiched) corresponding to M10, M12, M16, and M20.

At one side (the front side), the fitting depressed portion 8 is depressed. At the other side (the back side) on the opposite side of the one side, the continuous depressed groove 1308 is depressed. The continuous depressed groove 1308 is a depressed groove that has the same cross-sectional shape as that of the fitting depressed portion 8 and extends along the moving trajectory of the protrusion 72. Accordingly, when the movable jaw 4 advances and retreats, a fitting state of the protrusion 72 is always maintained.

Thus, when the movable jaw 4 advances and retreats, at one side illustrated in FIG. 18A, fitting between the protrusion 72 and the fitting depressed portion 8 is intermittently formed. In contrast, at the other side illustrated in FIG. 18B, fitting between the protrusion 72 and the continuous depressed groove 1308 is maintained. As a result, even in the case where rattling of the movable jaw 4 occurs with respect to the wrench body 3 due to deformation or abrasion of the sliding surface, the effect of guiding of the protrusion 72 at the other side by the continuous depressed groove 1308 allows the protrusion 72 to reliably fit each fitting depressed portion 8 at the one side.

In this case, at the other side illustrated in FIG. 18B, even in the case where the continuous depressed groove 1308 has a continuous shape, when the tool width-across-flats size B is adjusted, the intermittent fitting between the protrusion 72 and the fitting depressed portion 8 at the one side illustrated in FIG. 18A allows the worker to recognize that the protrusion 72 reaches the predetermined fitting depressed portion 8. That is, when the movable jaw 4 advances and retreats with respect to the fixed jaw 2 to be positioned in a predetermined position, this provides the positioning function, thus facilitating the adjustment of the tool width-across-flats size B.

On the other hand, even in the case where the width-across-flats size of the object to be sandwiched such as a nut is a width-across-flats size that cannot be set by fitting of the protrusion 72 into any fitting depressed portion 8 among the plurality of fitting depressed portions 8 at the one side illustrated in FIG. 18A, fitting between the protrusion 72 and the continuous depressed groove 1308 is maintained at the other side illustrated in FIG. 18B. Thus, this fitting suppresses rattling and provides an elastic force of the leaf spring portion 1307 in a direction to correct the rattling. As a result, the positioning function and the locking function are maintained with respect to an object to be sandwiched such as a nut with this width-across-flats size.

Additionally, the pair of leaf spring portions 1307 sandwiches the wrench body 3 from both side (the near-side in the paper and the far-side in the paper in FIG. 18A and FIG. 18B), thus effectively providing the elastic force of the leaf spring portion 1307 in the direction to correct the rattling of the movable jaw 4. This reliably provides the positioning function and the locking function.

Next, the monkey wrench 1401 in the fourteenth embodiment will be described with reference to FIG. 19. The monkey wrench 1401 of the fourteenth embodiment is different from the monkey wrench 1301 of the thirteenth embodiment only in that the second side surfaces 3*a*2 and 4*a*2 are depressed. The fourteenth embodiment is otherwise similar to the thirteenth embodiment. Therefore, only different points will be described below. Same reference numerals are given to the parts same to those of each embodiment above, and descriptions thereof are omitted.

Figure 19A:
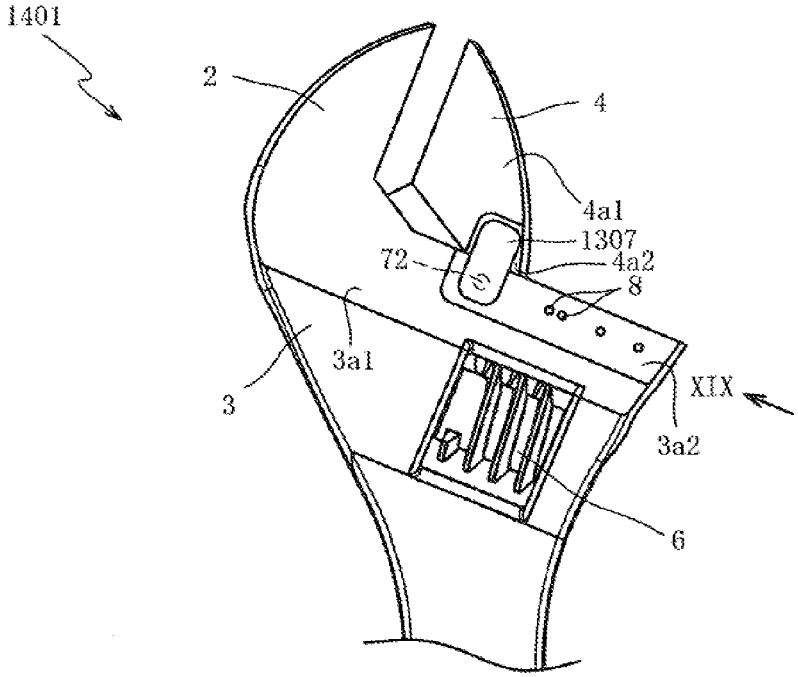
FIG. 19A is a partially enlarged front view of the monkey wrench according to the fourteenth embodiment.
Figure 19B:
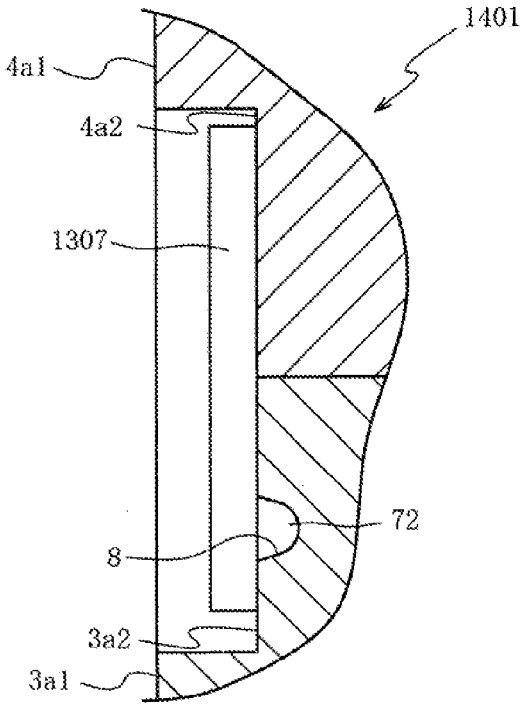
FIG. 19B and FIG. 19C are side views of the monkey wrench viewed in a direction of an arrow XIX of FIG. 19A.
Figure 19C:
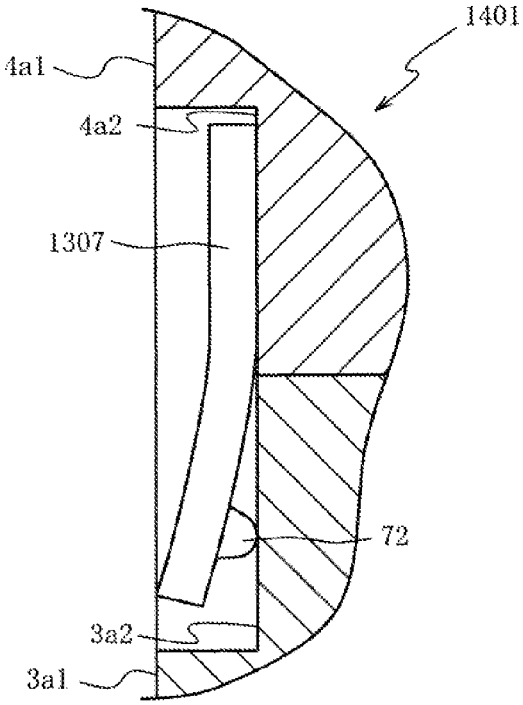

FIG. 19A is a partially enlarged front view of the monkey wrench 1401 according to the fourteenth embodiment. FIG. 19B and FIG. 19C are side views of the monkey wrench 1401 viewed in a direction of an arrow XIX of FIG. 19A.

FIG. 19B and FIG. 19C illustrate cross-sectional views of the wrench body 3 and the movable jaw 4. FIG. 19B corresponds to a state where the protrusion 72 fits the fitting depressed portion 8. FIG. 19C corresponds to a state where the protrusion 72 rides upon the second side surface 3*a*2 of the wrench body 3.

As illustrated in FIGS. 19A to 19C, in the monkey wrench 1401 of the fourteenth embodiment, the wrench body 3 and the movable jaw 4 include first side surfaces 3*a*1 and 4*a*1 and second side surfaces 3*a*2 and 4*a*2 in retreated positions with respect to the first side surfaces 3*a*1 and 4*a*1 (that is, at the far-side in the paper of FIG. 19A). That is, the wrench body 3 and the movable jaw 4 include side surfaces formed of the first side surfaces 3*a*1 and 4*a*1 and the second side surfaces 3*a*2 and 4*a*2. The second side surfaces 3*a*2 and 4*a*2 are formed by partially depressing a part of the first side surfaces 3*a*1 and 4*a*1. The fitting depressed portion 8 is depressed on the second side surface 3*a*2 of the wrench body 3. The leaf spring portion 1307 has a base end side firmly fixed to the second side surface 4*a*2 of the movable jaw 4.

This reduces protruding of the leaf spring portion 1307 from the first side surfaces 3*a*1 and 4*a*1 of the wrench body 3 and the movable jaw 4. Thus, this reduces interference of the leaf spring portion 1307 with another member during a fastening or loosening operation of an object to be sandwiched such as a nut to improve working efficiency. Additionally, this reduces damage to the leaf spring portion 1307.

In the fourteenth embodiment, the retreat amount (the right-left dimension of FIG. 19B and FIG. 19C) where the second side surfaces 3*a*2 and 4*a*2 are retreated with respect to the first side surfaces 3*a*1 and 4*a*1 is set to a dimension value when the leaf spring portion 1307 does not protrude from the first side surfaces 3*a*1 and 4*a*1 in a state where the protrusion 72 rides upon the second side surface 3*a*2 of the wrench body 3 as illustrated in FIG. 19C. Accordingly, even in the case where an object to be sandwiched such as a nut is fastened or loosened in a state where the protrusion 72 rides upon the second side surface 3*a*2, this reduces interference of the leaf spring portion 1307 with another member. As a result, this improves working efficiency and reduction of damage to the leaf spring portion 1307.

The present invention has been described above based on the embodiments; however, it can be easily presumed that the present invention is not limited to the embodiments described above by any means, and a variety of improvements and alterations are possible within the scope not departing from the objects of the present invention.

The numerical values described in each embodiment above are examples, and other numerical values are obviously possible. For example, the number of depressions such as the fitting depressed portions 8, the number of rows such as the rows 9*a* to 9*c*, or the nominal diameter of the object to be sandwiched described in each embodiment above may be set arbitrarily.

A part of configuration in each embodiment above may be replaced by a part of configuration in another embodiment. For example, the leaf spring portion 7 of the first embodiment may be replaced by the leaf spring portion 207 of the second embodiment or the leaf spring portion 307 of the third embodiment. Similarly, for example, while in the seventh embodiment the leaf spring portion 7 is employed on both side surfaces at the front side and other side, the leaf spring portion 7 at one of the front side or other side may be replaced by the leaf spring portion 207 of the second embodiment or the leaf spring portion 307 of the third embodiment.

Similarly, for example, the configuration at the back side of the seventh embodiment may be applied to the back side of the thirteenth or fourteenth embodiment. Specifically, in the thirteenth or fourteenth embodiment, instead of the continuous depressed groove 1308, the plurality of fitting depressed portions 708 (the row 709*a* to 709*c*) may be disposed with fitting margins (such as small fitting margins) in different size from that of the fitting depressed portion 8 at the front side. In this case, the fitting depressed portion 8 at the front side and the fitting depressed portion 708 at the back side are preferred to be shifted to positions where the fitting depressed portion 8 at the front side and the fitting depressed portion 708 at the back side are not fitted simultaneously. This allows the worker to recognize the width-across-flats size B by fitting between the fitting depressed portion 8 and the protrusion 72 at the front side and the width-across-flats size B by fitting between the fitting depressed portion 708 and the protrusion 72 at the back side, by a difference in operational feeling.

Similarly, for example, the configuration at the back side of the eleventh embodiment may be applied to the back side of the thirteenth or fourteenth embodiment. Specifically, in the thirteenth or fourteenth embodiment, instead of the continuous depressed groove 1308, a plurality of fitting depressed portions 808 (in the row 809*a*) may be disposed in equally spaced pitches (preferred to be pitches smaller than those of the fitting depressed portions 8 at the front side). This enhances the versatility and the convenience.

Similarly, the configurations at the back side of the thirteenth and fourteenth embodiments may be replaced by the configuration at the back side of the ninth embodiment. That is, in the thirteenth and fourteenth embodiments, the following configuration is possible. The continuous depressed groove 1308 disposed on the side surface 3*a* at the back side is omitted. The side surface 3*a* is formed in a flat surface shape. The protrusion 72 disposed in the leaf spring portion 1307 at the back side is omitted. The leaf spring portion 1307 and the side surface 3*a* are brought into contact with each other (or face each other through a slight gap).

A part or whole of configuration of each embodiment above may be combined with a part of or whole of configuration of another embodiment. For example, a combination of the row 9*a* of the first embodiment, the flat surface portion 403*b* of the fourth embodiment, and the continuous depressed groove 508 of the fifth embodiment may be disposed on the second side surface 3*a*1 of the wrench body 3. In this case, the row 9*a* may include the guide groove 608 of the sixth embodiment. For example, while in the seventh embodiment to the tenth embodiment the configuration (that is, the configuration where the rows 9*a* to 9*c* are disposed on the second side surface 3*a*1) of the first embodiment as the configuration at the front side is employed, the configuration at the front side may employ the configurations of the third embodiment to the sixth embodiment.

Similarly, for example, the second side surfaces 3*a*2 and 4*a*2 of the fourteenth embodiment may be applied to the back side of the thirteenth embodiment. That is, the following configuration is possible. The second side surfaces 3*a*2 and 4*a*2 are also depressed at the back side of the wrench body 3 and the movable jaw 4 of the thirteenth embodiment. The base portion of the leaf spring portion 1307 is fixedly secured to the second side surface 4*a*2 of the movable jaw 4. The plurality of fitting depressed portions 8 are depressed on the second side surface 3*a*2 of the wrench body 3. In this case, the depressed amount (the retreat amount where the second side surfaces 3*a*2 and 4*a*2 retreat with respect to the first side surfaces 3*a*1 and 4*a*1) of the second side surfaces 3*a*2 and 4*a*2 at the back side is preferred to be larger than the plate thickness dimension (the right-left dimension of FIG. 19B) of the leaf spring portion 1307. At the back side, the leaf spring portion 1307 does not protrude from the first side surfaces 3*a*1 and 4*a*1, and reduces interference with another member. As a result, this improves working efficiency and reduces damage to the leaf spring portion 1307.

Similarly, in the thirteenth and fourteenth embodiments, the fitting depressed portion 8 may be combined with the guide groove 608 of the sixth embodiment. That is, the plurality of fitting depressed portions 8 may be coupled together by the guide groove 608 to extend the guide groove 608 beyond the fitting depressed portion 8 in the end portion.

While in each embodiment described above the leaf spring portions 7, 207, 307, 907, 1007, 1107*a*, 1107*b*, and 1307 are formed of metallic material, this should not be construed in a limiting sense. Resin material may be used.

While in the first embodiment to the twelfth embodiment the fitting groove 4*b* is depressed on the movable jaw 4, this should not be construed in a limiting sense. The depression of the fitting groove 4*b* on the movable jaw 4 may be omitted. In this case, the depression of the second side surface 3*a*1 on the side surface 3*a* of the wrench body 3 is omitted, or the depression depth of the second side surface 3*a*1 is adjusted. That is, the fitting depressed portion 8 and the like are positioned in a position that allows fitting of the protrusion 72.

While in each embodiment described above the leaf spring portions 7, 207, 307, 1107*a*, 1207, and 1307 in a state where the protrusion 72 fits the fitting depressed portion 8 are not elastically deformed, this should not be construed in a limiting sense. In a state where the protrusion 72 and the like fit the fitting depressed portion 8, the protrusion height of the protrusion 72 or the depression depth of the fitting depressed portion 8 may be set such that the leaf spring portion 7 and the like are elastically deformed (that is, as illustrated in FIG. 19C, the leaf spring portion 1307 is elastically warped). This reduces occurrence of rattling between the protrusion 72 and the fitting depressed portion 8 due to dimensional tolerance in production, abrasion of the protrusion 72 or the fitting depressed portion 8, deformation or settling of the leaf spring portion 7 and the like, and other causes. As a result, this reliably provides the positioning function and the locking function described above. This is similar in the relationships between the protrusion 72 and each of the continuous depressed grooves 508, 1008, and 1308.

While in the fourteenth embodiment the retreat amount (the depression depth) of the second side surfaces 3*a*2 and 4*a*2 with respect to the first side surfaces 3*a*1 and 4*a*1 is set to the dimension value (see FIG. 19C) where the leaf spring portion 1307 does not protrude from the first side surfaces 3*a*1 and 4*a*1 in a state where the protrusion 72 rides upon the second side surface 3*a*2 of the wrench body 3, this should not be construed in a limiting sense. For example, the retreat amount may be set to a dimension value (that is, a state where the retreat amount is approximately equal to the plate thickness of the leaf spring portion 1307) where the leaf spring portion 1307 does not protrude from the first side surfaces 3*a*1 and 4*a*1 in a state where the protrusion 72 fits the fitting depressed portion 9 (that is, a state illustrated in FIG. 19B). This reduces interference of the leaf spring portion 1307 with another member while suppressing an unnecessarily large retreat amount of the second side surfaces 3*a*2 and 4*a*2, thus ensuring rigidity of the wrench body 3 and the movable jaw 4.

REFERENCE SIGNS LIST

1,301,401,501,601,701,801,901,1001,1101,1201,1301,1401 monkey wrench
2 fixed jaw
3 wrench body
3*a* side surface of a wrench body
3*a*1 first side surface
3*a*2 second side surface
403*b* flat surface portion
4 movable jaw
4*a* surface of a movable jaw
4*a*1 first side surface
4*a*2 second side surface
4*b* fitting groove
5 rack
6 worm
7,207,307,907,1007,1107*a*,1107*b*,1207,1307 leaf spring portion
72 protrusion
74*a*,74*b*,74*c*,274*a*,274*b* chamfered portions (part of positioning unit)
8,708,808 fitting depressed portion
508,1008,1308 continuous depressed groove
608 guide groove
9*a*,9*b*,9*c*,709*a*,709*b*,709*c*,809*a*,809*b*,809*c* row
376 positioning depressed portion (part of positioning unit)
B1 fastening bolt (part of positioning unit)
P ball plunger (part of positioning unit)

The invention claimed is:

1. A monkey wrench, comprising:

a wrench body including a fixed jaw;

a movable jaw configured to advance and retreat on the wrench body to sandwich an object to be sandwiched between the movable jaw and the fixed jaw; and a space adjusting mechanism where a rack formed at the movable jaw engages a worm turnably disposed at the wrench body, wherein the wrench body includes a plurality of fitting depressed portions depressed on a side surface of the wrench body along an advancing/retreating direction of the movable jaw and a plurality of rows parallel to one another, the rows being formed of the plurality of fitting depressed portions at spaces from one another in a direction perpendicular to the advancing/retreating direction of the movable jaw, and the movable jaw includes:

a leaf spring portion having: a base end side on the side surface of the movable jaw; and a distal end side facing the side surface of the wrench body, the leaf spring portion being formed as a leaf spring that is elastically deformable in a contact and separation direction with respect to the side surface of the wrench body;

a protrusion positioned at the distal end side of the leaf spring portion, the protrusion protruding toward the side surface of the wrench body, the protrusion being formed to fit the fitting depressed portion; and a positioning unit configured to position the leaf spring portion in each position that allows fitting of the protrusion into the fitting depressed portion in each row among the plurality of the rows.

2. The monkey wrench according to claim 1, wherein the movable jaw includes a fitting groove depressed in a groove shape on the side surface of the wrench body, the fitting groove including opposed inner wall surfaces, the inner wall surfaces extending in a direction perpendicular to the advancing/retreating direction of the movable jaw, and the leaf spring portion is disposed on the side surface of the movable jaw in a state where the leaf spring portion is mounted on an inner side of the fitting groove, and the inner wall surfaces of the fitting groove restricts movement of the leaf spring portion in the advancing/retreating direction of the movable jaw.

3. The monkey wrench according to claim 1 or 2, wherein the wrench body includes a flat surface portion formed in a flat shape along the advancing/retreating direction of the movable jaw, and the positioning unit allows positioning the leaf spring portion in a position where the protrusion is arranged in the flat surface portion.

4. The monkey wrench according to claim 1 or 2, wherein the wrench body includes a continuous depressed groove formed to fit the protrusion, the continuous depressed groove continuously extending in a groove shape along the advancing/retreating direction of the movable jaw, and the positioning unit allows positioning the leaf spring portion in a position where the protrusion fits the continuous depressed groove.

5. The monkey wrench according to claim 1 or 2, wherein at least one row among the plurality of rows is arranged such that the plurality of fitting depressed portions are equally spaced along the advancing/retreating direction of the movable jaw.

6. The monkey wrench according to claim 1 or 2, wherein the wrench body includes a guide groove depressed in a groove shape on the side surface of the wrench body, the guide groove coupling the plurality of fitting depressed portions in at least one row among the plurality of rows, the guide groove having a smaller fitting margin when the protrusion is fitted than a fitting margin when the fitting depressed portion fits the protrusion.

7. The monkey wrench according to claim 1 or 2, wherein the leaf spring portion, the protrusion, the plurality of rows, and the positioning unit are each disposed on both side surfaces of one side surfaces of the movable jaw and the wrench body and another side surfaces on an opposite side of the one side surface.

8. The monkey wrench according to claim 7, wherein a positional relationship between the protrusion on the one side surface and each fitting depressed portion in one row among the plurality of rows is the same as a positional relationship between the protrusion on the other side surface and each fitting depressed portion in one row among the plurality of rows, and when the movable jaw advances and retreats: in a case where the protrusion fits the fitting depressed portion in the one row on the one side surface, the protrusion fits the fitting depressed portion in the one row on the other side surface; in a case where the protrusion does not fit the fitting depressed portion in the one row on the one side surface, the protrusion does not fit the fitting depressed portion in the one row on the other side surface.

9. The monkey wrench according to claim 7, wherein a positional relationship between the protrusion on the one side surface and each fitting depressed portion in one row among the plurality of rows is different from a positional relationship between the protrusion on the other side surface and each fitting depressed portion in one row among the plurality of rows, and when the movable jaw advances and retreats: in a case where the protrusion fits the fitting depressed portion in the one row on the one side surface, the protrusion does not fit the fitting depressed portion in the one row on the other side surface; in a case where the protrusion fits the fitting depressed portion in the one row on the other side surface, the protrusion does not fit the fitting depressed portion in the one row on the one side surface.

10. The monkey wrench according to claim 9, wherein on the one side surface or the other side surface, each row among the plurality of rows includes the plurality of fitting depressed portions equally spaced from one another along the advancing/retreating direction of the movable jaw, and the spacings are different for each row.

11. The monkey wrench according to claim 9, wherein a fitting margin between the protrusion and each fitting depressed portion in at least one row among the plurality of rows on the one side surface is different from a fitting margin between the protrusion and each fitting depressed portion in at least one row among the plurality of rows on the other side surface.

12. The monkey wrench according to claim 7, wherein the wrench body includes a flat surface portion on each of the one side surface and the other side surface, the flat surface portion being formed in a flat surface shape along the advancing/retreating direction of the movable jaw, and the positioning unit is configured to position the leaf spring portion in a position where the protrusion is arranged in the flat surface portion on the one side surface and the other side surface.

13. The monkey wrench according to claim 7, wherein the wrench body includes a continuous depressed groove on each of the one side surface and the other side surface, the continuous depressed groove being formed to fit the protrusion, the continuous depressed groove continuously extending in a groove shape along the advancing/retreating direction of the movable jaw, and the positioning unit is configured to position the leaf spring portion in a position where the protrusion fits the continuous depressed groove on the one side surface and the other side surface.

14. The monkey wrench according to claim 7, wherein a fitting margin between the protrusion and each fitting depressed portion in at least one row among the plurality of rows on the one side surface is different from a fitting margin between the protrusion and each fitting depressed portion in at least one row among the plurality of rows on the other side surface.

15. The monkey wrench according to claim 1, wherein the leaf spring portion, the protrusion, the plurality of rows, and the positioning unit are each disposed on first side surfaces of the movable jaw and the wrench body, and the leaf spring portion including another portion fixedly secured on another side surface on an opposite side of the first side surface in the movable jaw, the another side surface on an opposite side of the first side surface of the wrench body has a portion being not depressed but at least a region facing a moving trajectory of the leaf spring portion being formed in a flat surface shape on the another side surface of the wrench body.

16. The monkey wrench according to claim 1, wherein the leaf spring portion, the protrusion, the plurality of rows, and the positioning unit are each disposed on first side surfaces of the movable jaw and the wrench body, and the leaf spring portion including another portion and the protrusion including another portion that are fixedly secured on another side surface on an opposite side of the first side surface in the movable jaw, a continuous depressed groove being formed to fit the protrusion on the other side surface of the wrench body, the continuous depressed groove continuously extending in a groove shape along the advancing/retreating direction of the movable jaw.

17. The monkey wrench according to claim 15 or 16, wherein the wrench body includes a guide groove depressed in a groove shape on the first side surface of the wrench body, the guide groove coupling the plurality of fitting depressed portions in at least one row among the plurality of rows, the guide groove having a smaller fitting margin when the protrusion is fitted than a fitting margin when the fitting depressed portion fits the protrusion.

18. A monkey wrench, comprising:

a wrench body including a fixed jaw;

a movable jaw configured to slide on the wrench body to sandwich an object to be sandwiched between the movable jaw and the fixed jaw; and a space adjusting mechanism where a rack formed at the movable jaw engages a worm turnably disposed at the wrench body, wherein the movable jaw includes:

a leaf spring portion having: a base end side firmly fixed to the side surface of the movable jaw, and a distal end side facing the side surface of the wrench body, the leaf spring portion being formed as a leaf spring that is elastically deformable in a contact and separation direction with respect to the side surface of the wrench body; and a protrusion positioned at the distal end side of the leaf spring portion, the protrusion protruding toward the side surface of the wrench body, wherein the leaf spring portion and the protrusion are disposed on both side surfaces of one side surface and another side surface on an opposite side of the one side surface in the movable jaw, and the wrench body includes:

a plurality of fitting depressed portions depressed on one side surface of the wrench body such that the protrusion of the leaf spring portion is intermittently fitted when the movable jaw advances and retreats; and a continuous depressed groove depressed on another side surface on an opposite side of the one side surface of the wrench body, the continuous depressed groove extending along a moving trajectory of the protrusion to maintain fitting of the protrusion when the movable jaw advances and retreats.

19. The monkey wrench according to claim 18, wherein the one side surface of the wrench body and the one side surface of the movable jaw among both side surfaces of the wrench body and both side surfaces of the movable jaw include a first side surface and a second side surface, the second side surface being formed by partially depressing a part of the first side surface in a retreat position with respect to the first side surface, and the plurality of fitting depressed portions are depressed on the second side surface of the wrench body, and the base end side of the leaf spring portion being firmly fixed to the second side surface of the movable jaw.

20. The monkey wrench according to claim 19, wherein a retreat amount of the second side surface with respect to the first side surface is set to a dimension value where the leaf spring portion does not protrude from the first side surface in a state where the protrusion rides upon the second side surface of the wrench body.

* * * * *